US010591188B2

(12) United States Patent
Sakima et al.

(10) Patent No.: US 10,591,188 B2
(45) Date of Patent: Mar. 17, 2020

(54) REFRIGERATION CYCLE DEVICE USING WORKING FLUID CONTAINING 1,1,2-TRIFLUOROETHYLENE (R1123) AND DIFLUOROMETHANE (R32)

(71) Applicant: Panasonic Intellectual Property Management Co., Ltd., Osaka-shi, Osaka (JP)

(72) Inventors: Fuminori Sakima, Shiga (JP); Akira Fujitaka, Shiga (JP); Shigehiro Sato, Shiga (JP); Kenji Takaichi, Osaka (JP); Yoshikazu Kawabe, Shiga (JP); Hiroaki Nakai, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 420 days.

(21) Appl. No.: 15/309,977

(22) PCT Filed: May 8, 2015

(86) PCT No.: PCT/JP2015/002342
§ 371 (c)(1),
(2) Date: Nov. 9, 2016

(87) PCT Pub. No.: WO2015/174054
PCT Pub. Date: Nov. 19, 2015

(65) Prior Publication Data

US 2017/0138645 A1 May 18, 2017

(30) Foreign Application Priority Data

May 12, 2014 (JP) ..... 2014-098347
Mar. 9, 2015 (JP) ..... 2015-046354

(51) Int. Cl.
*F25B 9/00* (2006.01)
*F25B 13/00* (2006.01)
(Continued)

(52) U.S. Cl.
CPC ..... *F25B 13/00* (2013.01); *F25B 1/00* (2013.01); *F25B 9/006* (2013.01); *F25B 41/04* (2013.01);
(Continued)

(58) Field of Classification Search
CPC .. F25B 9/002; F25B 9/006; F25B 2600/2513; F25B 2700/2115; F25B 2700/12252; F25B 2700/12256; F25B 2700/21157
See application file for complete search history.

(56) References Cited

U.S. PATENT DOCUMENTS 5,873,255 A * 2/1999 Madigan ..... F04C 29/0014 62/505
7,096,683 B2 * 8/2006 Smith ..... B60H 1/00207 62/200
(Continued)

FOREIGN PATENT DOCUMENTS

EP 2711405 A1 3/2014
JP 62-069767 U 5/1987
(Continued)

OTHER PUBLICATIONS

The Sigarpore Search Report dated Oct. 30, 2017 for the Sigarpore Patent Application No. 11201609323W.
(Continued)

*Primary Examiner* — Henry T Crenshaw
*Assistant Examiner* — Daniel C Comings
(74) *Attorney, Agent, or Firm* — Hamre, Schumann, Mueller & Larson, P.C.

(57) ABSTRACT

A refrigeration cycle device includes a refrigeration cycle formed by connecting a compressor, a condenser, an expansion valve and an evaporator to each other. As a refrigerant in the refrigeration cycle, a working fluid containing 1,1,2-trifluoroethylene (R1123) and difluoromethane (R32) is
(Continued)

used. A degree of opening of the expansion valve is controlled such that the refrigerant has two phases at a suction portion of the compressor.

6 Claims, 16 Drawing Sheets

(51) Int. Cl.

| | |
|---|---|
| ***F25B 1/00*** | (2006.01) |
| ***F25B 49/02*** | (2006.01) |
| ***F25B 49/00*** | (2006.01) |
| ***F25B 45/00*** | (2006.01) |
| ***F25B 41/04*** | (2006.01) |

(52) U.S. Cl.

CPC ..... *F25B 45/00* (2013.01); *F25B 49/005* (2013.01); *F25B 49/02* (2013.01); *F25B 49/022* (2013.01); *F25B 9/002* (2013.01); *F25B 2400/0411* (2013.01); *F25B 2500/08* (2013.01); *F25B 2600/17* (2013.01); *F25B 2600/19* (2013.01); *F25B 2600/21* (2013.01); *F25B 2600/2513* (2013.01); *F25B 2700/191* (2013.01); *F25B 2700/195* (2013.01); *F25B 2700/2115* (2013.01); *F25B 2700/2116* (2013.01); *F25B 2700/2117* (2013.01); *F25B 2700/21151* (2013.01); *F25B 2700/21163* (2013.01)

(56) References Cited

U.S. PATENT DOCUMENTS

| | | | | |
|---|---|---|---|---|
| 2009/0090117 | A1 | 4/2009 | McSweeney | |
| 2011/0023512 | A1* | 2/2011 | Kawagoe | F25B 13/00 62/196.1 |
| 2014/0070132 | A1* | 3/2014 | Fukushima | F25B 9/002 252/67 |
| 2014/0077123 | A1 | 3/2014 | Fukushima | |
| 2014/0182329 | A1 | 7/2014 | Yamashita et al. | |
| 2014/0363311 | A1* | 12/2014 | Schreiber | F04D 29/058 417/53 |

FOREIGN PATENT DOCUMENTS

| | | | | |
|---|---|---|---|---|
| JP | 5-240511 | A | | 9/1993 |
| JP | 9-014805 | A | | 1/1997 |
| JP | 11-162311 | | * | 6/1999 |
| JP | 11-316057 | A | | 11/1999 |
| JP | 2001-072966 | A | | 3/2001 |
| JP | 2008-157550 | A | * | 7/2008 |
| JP | 2009-144950 | A | | 7/2009 |
| JP | 2009-300023 | A | | 12/2009 |
| JP | 2010-001775 | A | | 1/2010 |
| JP | 2010-008002 | A | | 1/2010 |
| JP | 2010101558 | A | * | 5/2010 |
| JP | 2010-156524 | A | | 7/2010 |
| JP | 2011-174672 | A | | 9/2011 |
| JP | 2012102967 | A | * | 5/2012 |
| WO | 2005/068919 | A1 | | 7/2005 |
| WO | 2012/157764 | | | 11/2012 |
| WO | 2012/157765 | | | 11/2012 |
| WO | 2013/069044 | A1 | | 5/2013 |
| WO | 2013/113785 | A1 | | 8/2013 |

OTHER PUBLICATIONS

The Extended European Search Report dated Apr. 10, 2017 for the related European Patent Application No. 15792337.6.

* cited by examiner

REFRIGERATION CYCLE DEVICE USING WORKING FLUID CONTAINING 1,1,2-TRIFLUOROETHYLENE (R1123) AND DIFLUOROMETHANE (R32)

This application is a US National Phase Application of PCT International Application PCT/JP2015/002342.

TECHNICAL FIELD

The present invention relates to a refrigeration cycle device which uses a working fluid including R1123.

BACKGROUND ART

In general, a refrigeration cycle device is formed of: a compressor; a four-way valve when necessary; a radiator (or a condenser), a pressure reducer such as a capillary tube or an expansion valve; an evaporator and the like. A refrigeration cycle circuit is formed by connecting these constitutional elements with each other by pipes. A cooling or heating operation is performed by circulating a refrigerant in the inside of the pipes.

As a refrigerant used for a refrigeration cycle device, there has been known a halogenated hydrocarbon induced from methane or ethane referred to as a chlorofluorocarbon group. Usually, it is stipulated in US ASHRAE34 standard that a chlorofluorocarbon group is expressed as R•• or R•••. Accordingly, hereinafter, the description will be made by expressing a chlorofluorocarbon group as R•• or R•••.

As a refrigerant for a conventional refrigeration cycle device, R410A has been popularly used. However, R410A exhibits a large Global-Warming Potential (hereinafter, abbreviated as "GWP") of 1730 and hence, the use of R410A has a drawback from a viewpoint of prevention of global warming.

In view of the above, as a refrigerant having small GWP, for example, R1123 (1,1,2-trifluoroethylene) and R1132 (1,2-difluoroethylene) have been proposed (see Patent Literature 1 or Patent Literature 2, for example).

However, R1123 and R1132 exhibit low stability compared to a conventional refrigerant such as R410A. Accordingly, when a refrigerant generates a radical, there is a possibility that the refrigerant is converted into another compound due to disproportionation reaction. The disproportionation reaction causes a discharge of a large amount of heat and hence, there is a possibility that reliability of a compressor or a refrigeration cycle device is lowered due to abnormal heat generation. In view of the above, when R1123 or R1132 is used in a compressor or a refrigeration cycle device, it is necessary to suppress the above-mentioned disproportionation reaction.

CITATION LIST

Patent Literatures

PTL 1: WO 2012/157764 (A1)
PTL 1: WO 2012/157765 (A1)

SUMMARY OF THE INVENTION

The present invention provides a refrigeration cycle device which can suppress a disproportionation reaction even when a working fluid containing R1123 is used.

That is, a refrigeration cycle device according to the present invention includes a refrigeration cycle circuit formed by connecting a compressor, a condenser, an expansion valve and an evaporator to each other. As a refrigerant sealed in the refrigeration cycle circuit, a working fluid containing 1,1,2-trifluoroethylene (R1123) and difluoromethane (R32) is used. The refrigeration cycle device is also configured such that a degree of opening of the expansion valve is controlled such that the refrigerant has two phases at a suction portion of the compressor.

With such a configuration, it is possible to perform a control such that a working fluid does not enter a body of the compressor in a superheated state (abnormal heat generation state). Accordingly, it is possible to prevent the occurrence of a phenomenon that a compressor discharge temperature of the working fluid is excessively increased so that the molecular movement of R1123 in the working fluid is activated. As a result, a disproportionation reaction of the working fluid containing R1123 is suppressed so that a highly reliable refrigeration cycle device can be provided.

DESCRIPTION OF EMBODIMENTS

Hereinafter, exemplary embodiments of the present invention are described with reference to drawings. The present invention is not limited by these exemplary embodiments.

(First Exemplary Embodiment)

A refrigeration cycle device according to a first exemplary embodiment of the present invention is described with reference to FIG. 1.

Figure 1:
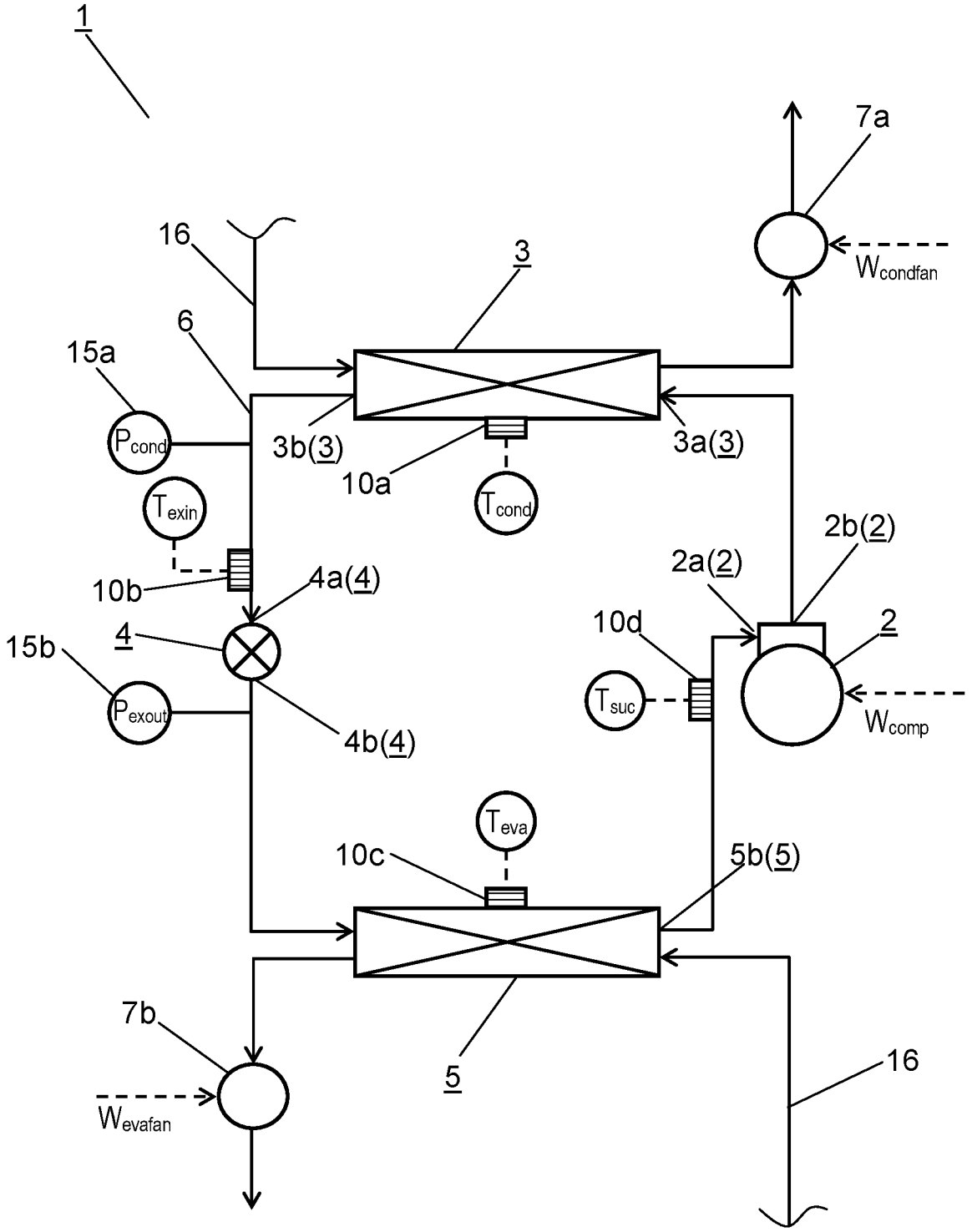
FIG. 1 is a schematic constitutional view of a refrigeration cycle device according to a first exemplary embodiment of the present invention.

FIG. 1 is a schematic constitutional view of a refrigeration cycle device according to the first exemplary embodiment of the present invention.

As shown in FIG. 1, refrigeration cycle device 1 according to this exemplary embodiment is formed of at least compressor 2, condenser 3, expansion valve 4, evaporator 5, refrigerant pipe 6, fluid passage 16 of surrounding mediums and the like. A refrigeration cycle circuit is formed by sequentially connecting these constitutional elements by refrigerant pipe 6. In such a configuration, a working fluid (refrigerant) described hereinafter is sealed in the refrigeration cycle circuit.

First, a working fluid used in the refrigeration cycle device according to this exemplary embodiment is described.

A working fluid sealed in refrigeration cycle device 1 is formed of a mixed fluid of a two-component system formed of R1123 (1,1,2-trifluoroethylene) and R32 (difluoromethane).

In this exemplary embodiment, a working fluid is formed of a mixed working fluid (mixed refrigerant) containing 30 weight % to 60 weight % inclusive of R32. That is, by mixing 30 weight % or more of R32 into R1123, a disproportionation reaction of R1123 can be suppressed. The higher the concentration of R32, the more the disproportionation reaction of R1123 can be suppressed. The reason is as follows.

Firstly, the mixed working fluid has a function of alleviating a disproportionation reaction due to small polarization of R32 to fluorine atoms. Secondly, R1123 and R32 have the similar physical properties and hence, R1123 and R32 exhibit the similar behaviors at the time of change in phase such as condensation or evaporation. Accordingly, the mixed working fluid has a function of reducing opportunity that a disproportionation reaction of R1123 occurs. Due to such actions, a disproportionation reaction of R1123 can be suppressed.

The mixed refrigerant formed of R1123 and R32 has an azeotropic point when the mixed working fluid contains 30 weight % of R32 and 70 weight % of R1123 so that temperature slip is eliminated. Accordingly, the mixed refrigerant can be treated in the same manner as a single refrigerant while being a mixed working fluid. On the other hand, when mixed refrigerant contains 60 weight % or more of R32, temperature slip becomes large. Accordingly, it becomes difficult to treat the mixed refrigerant in the same manner as a single refrigerant and hence, it is desirable that R32 be mixed at a ratio of 60 weight % or less. It is more desirable that R32 be mixed at a ratio of 40 weight % or more and 50 weight % or less. With such setting of an amount of R32, a disproportionation reaction can be prevented and at the same time, the mixed refrigerant approximates an azeotropic point so that temperature slip can be further reduced. As a result, an equipment such as a refrigeration cycle device can be easily designed.

Next, an effect of a mixing ratio of the mixed refrigerant made of R1123 and R32 is described with reference to (Table 1) and (Table 2).

(Table 1) and (Table 2) show a comparison of values of refrigeration capacities and cycle efficiencies (COP) of refrigeration cycle circuits when a mixing ratio of R32 is set to values which fall within a range of 30 weight % or more and 60 weight % or less provided that a pressure, a temperature and a displacement volume of a compressor are set equal among the refrigeration cycle circuits. The values are calculated under the following conditions. Further, for comparison, values obtained when a ratio of R410A is 100% and values obtained when a ratio of R1123 is 100% are also shown in the tables.

Firstly, the calculation conditions used in (Table 1) and (Table 2) are described.

Recently, the sophistication of performance of a heat exchanger has been in progress to enhance cycle efficiency of equipment. In accordance with such a trend, in an actual running state of the heat exchanger, a tendency is observed where a condensation temperature is lowered and an evaporation temperature is increased. As a result, a tendency is observed where a discharge temperature is also lowered.

In view of the above, by taking into account actual running conditions, as cooling calculation conditions in (Table 1), an evaporation temperature is set to 15° C., a condensation temperature is set to 45° C., a degree of superheat of a refrigerant at a suction inlet of the compressor is set to 5° C., and a degree of supercooling at a discharge outlet of the condenser is set to 8° C. corresponding to conditions for cool running of an air conditioner (indoor dry-bulb temperature 27° C., wet-bulb temperature 19° C. and outdoor dry-bulb temperature 35° C.).

In the same manner, as warming calculation conditions in (Table 2), an evaporation temperature is set to 2° C., a condensation temperature is set to 38° C., a degree of superheat of a refrigerant at a suction inlet of the compressor is set to 2° C., and a degree of supercooling at a discharge outlet of the condenser is set to 12° C. corresponding to conditions for warm running of an air conditioner (indoor dry-bulb temperature 20° C., outdoor dry-bulb temperature 7° C. and wet-bulb temperature 6° C.).

Results obtained by calculation are shown in the following (Table 1) and (Table 2).

TABLE 1

| | | refrigerant | | | | | |
|---|---|---|---|---|---|---|---|
| | | R410A | R32/R1123 60/40 | R32/R1123 50/50 | R32/R1123 40/60 | R32/R1123 30/70 | R1123 |
| GWP | — | 2090 | 410 | 350 | 280 | 210 | 5 |
| condensation pressure | MPa | 2.73 | 3.17 | 3.23 | 3.28 | 3.33 | 3.44 |
| evaporation pressure | MPa | 1.25 | 1.48 | 1.51 | 1.55 | 1.59 | 1.70 |
| discharge temperature | ° C. | 62 | 69 | 68 | 67 | 66 | 65 |
| refrigeration capacity | % | 100% | 118% | 119% | 120% | 121% | 125% |
| COP | % | 100% | 97% | 96% | 95% | 94% | 91% |

TABLE 2

| | | refrigerant | | | | | |
|---|---|---|---|---|---|---|---|
| | | R410A | R32/R1123 60/40 | R32/R1123 50/50 | R32/R1123 40/60 | R32/R1123 30/70 | R1123 |
| GWP | — | 2090 | 410 | 350 | 280 | 210 | 5 |
| condensation pressure | MPa | 2.30 | 2.69 | 2.75 | 2.79 | 2.84 | 2.95 |
| evaporation pressure | MPa | 0.87 | 0.96 | 0.99 | 1.01 | 1.03 | 1.14 |
| discharge temperature | ° C. | 56 | 65 | 64 | 63 | 62 | 60 |
| refrigeration capacity | % | 100% | 118% | 119% | 120% | 121% | 125% |
| COP | % | 100% | 97% | 96% | 95% | 94% | 91% |

As shown in (Table 1) and (Table 2), it is understood that when R32 is mixed to R1123 at a ratio which falls within a range of 30 weight % to 60 weight % inclusive, in both cool and warm running, compared to the case where R410A is used as a refrigerant, refrigeration capacity is increased by approximately 20%, cycle efficiency (COP) is increased to 94% to 97%, and a warming coefficient can be reduced to 10% to 20% of a global-warming potential of R410A.

As has been described above, in the mixed working fluid of a two-component system made of R1123 and R32, to consider in a comprehensive manner, the prevention of a disproportionation reaction, magnitude of temperature slip, refrigeration capacity at the time of cool running or warm running and COP (that is, to specify a mixing ratio suitable for an air conditioner which uses a compressor described later), it is desirable to use a mixture which contains 30 weight % or more and 60 weight % or less of R32. It is further desirable to use a mixture which contains 40 weight % or more and 50 weight % or less of R32.

Accordingly, in the refrigeration cycle device according to this exemplary embodiment, a refrigerant where mixing of components is performed in the above-mentioned range is used as a mixed working fluid (hereinafter also abbreviated as "working fluid" or simply "refrigerant").

Next, the configuration of the refrigeration cycle device according to this exemplary embodiment is described.

Compressor 2 is formed of, for example, a positive-displacement compressor of a rotary piston type, a scroll type or a reciprocating type or a centrifugal compressor.

When a surrounding medium is air, condenser 3 and evaporator 5 are formed of, for example, a fin-and-tube heat exchanger, a parallel-flow-type (micro-tube-type) heat exchanger or the like. On the other hand, when a surrounding medium is a brine or a refrigerant used in a dual refrigeration cycle device, condenser 3 and evaporator 5 are formed of, for example, a double-tube heat exchanger, a plate-type heat exchanger or a shell-and-tube-type heat exchanger.

Expansion valve 4 is formed of, for example, a pulse-motor-drive electronic expansion valve.

In condenser 3 of refrigeration cycle device 1, fluid machine 7*a* which forms a first conveyance part mounted in fluid passage 16 for a surrounding medium is disposed. Fluid machine 7*a* drives a surrounding medium (first medium) which performs a heat exchange with a refrigerant or allows such a surrounding medium to flow toward a heat exchange surface of condenser 3. In evaporator 5 of refrigeration cycle device 1, fluid machine 7*b* which forms a second conveyance part mounted in fluid passage 16 for a surrounding medium is disposed. Fluid machine 7*b* drives a surrounding medium (second medium) which performs a heat exchange with a refrigerant or allows such a surrounding medium to flow toward a heat exchange surface of evaporator 5.

As the surrounding medium, for example, air in atmosphere, water or brine such as ethylene glycol is usually used. When refrigeration cycle device 1 is a dual refrigeration cycle device, as a surrounding medium, a refrigerant which is preferable for a refrigeration cycle circuit and a working temperature region is used. Such a refrigerant is, for example, hydrofluorocarbon (HFC), hydrocarbon (HC), carbon dioxide or the like.

As fluid machine 7*a*, 7*b*, when a surrounding medium is air, for example, an axial blower such as a propeller fan, a cross flow fan or a centrifugal fan such as a turbo fan may be used. When a surrounding medium is brine, for example, a centrifugal pump is used as fluid machine 7*a*, 7*b*.

When refrigeration cycle device 1 is a dual refrigeration cycle device, a compressor for a surrounding medium plays a role as fluid machine 7*a*, 7*b* for conveying the surrounding medium.

Condensation temperature detecting part 10*a* is disposed in a portion of condenser 3 where a refrigerant which flows in condenser 3 flows in two phases (in a state where the refrigerant flows as a gas-liquid mixture). Such a portion is hereinafter referred to as "two-phase pipe of condenser". With such a configuration, condensation temperature detecting part 10*a* can measure a temperature of a refrigerant which flows in a two-phase pipe of condenser 3.

In refrigerant pipe 6 disposed between exit 3*b* of condenser 3 and inlet 4*a* of expansion valve 4, condenser exit temperature detecting part 10*b* is disposed. Condenser exit temperature detecting part 10*b* detects a degree of super-cooling (a value obtained by subtracting a condenser temperature from an inlet temperature of expansion valve 4) at inlet 4*a* of expansion valve 4.

Evaporation temperature detecting part 10*c* is disposed in a portion of evaporator 5 where a refrigerant which flows in evaporator 5 flows in two phases. Such a portion is hereinafter referred to as "two-phase pipe of evaporator". With such a configuration, evaporation temperature detecting part 10*c* can measure a temperature of a refrigerant which flows in a two-phase pipe of evaporator 5.

Suction temperature detecting part 10*d* is disposed in a suction portion of compressor 2 (between exit 5*b* of evaporator 5 and inlet 2*a* of compressor 2). Suction temperature detecting part 10*d* measures a temperature (suction temperature) of a refrigerant sucked into compressor 2.

Condensation temperature detecting part 10*a*, condenser exit temperature detecting part 10*b*, evaporation temperature detecting part 10*c* and suction temperature detecting part 10*d* described above are formed of, for example, an electronic thermostat which is brought into contact and connected with a pipe in which a refrigerant flows or an outer pipe of a heat transfer pipe. Condensation temperature detecting part 10*a* may be also formed of, for example, a sheath-type electronic thermostat which is directly brought into contact with a working fluid.

High-pressure-side pressure detecting part 15*a* is disposed between exit 3*b* of condenser 3 and inlet 4*a* of expansion valve 4. High-pressure-side pressure detecting part 15*a* detects a pressure on a high pressure side of the refrigeration cycle circuit (region from exit 2*b* of compressor 2 to inlet 4*a* of expansion valve 4 where a refrigerant exists at a high pressure).

Low-pressure-side pressure detecting part 15*b* is disposed at outlet 4*b* of expansion valve 4. Low-pressure-side pressure detecting part 15*b* detects a pressure on a low pressure side of the refrigeration cycle circuit (region from exit 4*b* of expansion valve 4 to inlet 2*a* of compressor 2 where a refrigerant exists at a low pressure).

Above-mentioned high-pressure-side pressure detecting part 15*a* and low-pressure-side pressure detecting part 15*b* may be formed of a diaphragm which converts displacement into an electrical signal. Differential pressure gauge (a measuring part which measures pressure difference between pressure at exit 4*b* and pressure at inlet 4*a* of expansion valve 4) may be used in place of high-pressure-side pressure detecting part 15*a* and low-pressure-side pressure detecting part 15*b*. In this case, the configuration can be simplified.

In the description of refrigeration cycle device 1 according to this exemplary embodiment, the description is made with respect to the configuration which includes condensation temperature detecting part 10*a*, condenser exit temperature detecting part 10*b*, evaporation temperature detecting part 10*c*, suction temperature detecting part 10*d*, high-pressure-side pressure detecting part 15*a*, and low-pressure-side pressure detecting part 15*b* as an example. However, refrigeration cycle device 1 is not limited to such configuration. For example, it is needless to say that the detecting part may be omitted when a detection value of the detecting part is not used in a control described later.

The refrigeration cycle device according to this exemplary embodiment has the above-mentioned configuration.

The manner of operation of the refrigeration cycle device according to this exemplary embodiment is described hereinafter with reference to FIG. 2.

Figure 2:
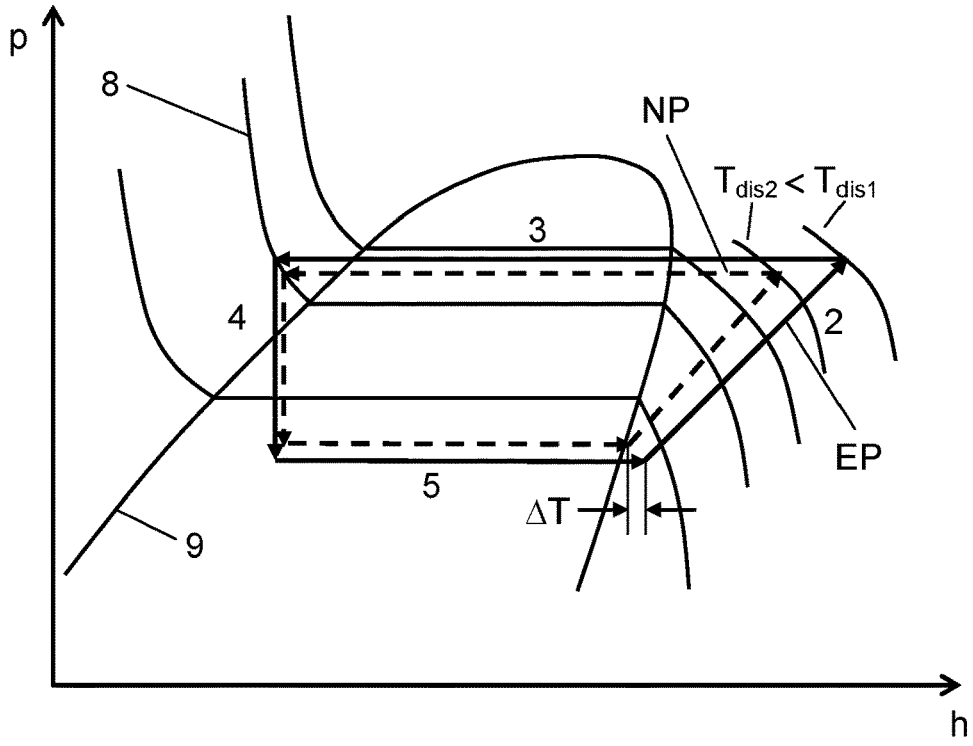
FIG. 2 is a Mollier chart for describing an operation of the refrigeration cycle device according to the first exemplary embodiment of the present invention.

FIG. 2 is a Mollier chart for describing an operation of the refrigeration cycle device according to the first exemplary embodiment of the present invention. In the drawing, EP indicated by a solid-line arrow indicates a refrigeration cycle when a compressor discharge temperature of a working fluid in refrigeration cycle device 1 is excessively increased. In the same manner, NP indicated by a broken-line arrow in the drawing indicates a refrigeration cycle in normal running of refrigeration cycle device 1.

Firstly, as shown in FIG. 2, a refrigerant (working fluid) containing R1123 used for refrigeration cycle device 1 is boosted (compressed) by compressor 2. Then, the refrigerant becomes a high-temperature and high-pressure super-heated gas and enters condenser 3. A heat exchange is performed between the high-temperature and high-pressure super-heated gas and a surrounding medium which enters condenser 3 by being driven by fluid machine 7*a* which forms the first conveyance part. With such an operation, heat of the super-heated gas is dissipated to the surrounding medium while a temperature of the super-heated gas is lowered till the temperature reaches saturation vapor line 9.

After the working fluid passes saturation vapor line 9, the working fluid becomes a two-phase fluid which is a gas-liquid mixture. Accordingly, condensation heat generated by condensation of the two-phase fluid per se is dissipated to a surrounding medium. Then, after the working fluid passes saturation liquid line 9, the working fluid is introduced into expansion valve 4 in a super-cooled state and in an intermediate-temperature and high-pressure state.

Expansion valve 4 expands the introduced working fluid. The expanded working fluid becomes a two-phase fluid which is a gas-liquid mixture of low temperature and low pressure, and reaches evaporator 5.

The working fluid which reaches evaporator 5 absorbs heat from a surrounding medium which is made to flow by being driven by fluid machine 7*b* which forms the second conveyance part. Accordingly, the working fluid per se is evaporated and is gasified.

The gasified working fluid is introduced into the suction portion of compressor 2 again, and a pressure of the working fluid is increased again.

The refrigeration cycle which is the operation of refrigeration cycle device 1 according to this exemplary embodiment is performed as described above.

Next, a working fluid containing R1123 which is used in refrigeration cycle device 1 according to this exemplary embodiment is described.

A working fluid containing R1123 has an advantage that a GWP value which is a global-warming potential is largely reduced as described above. On the other hand, such a working fluid is likely to generate a disproportionation reaction. The disproportionation reaction is a reaction where a radical is changed to a compound when the radical is produced in a refrigeration cycle circuit. The disproportionation reaction causes a discharge of a large amount of heat and hence, there is a possibility that reliability of compressor 2 and refrigeration cycle device 1 is lowered due to abnormal heat generation.

A condition where a disproportionation reaction occurs is, from a microscopic field of view, narrowing of an intermolecular distance or a state where the behavior of molecules is active. On the other hand, the condition where a disproportionation reaction occurs is, from a macroscopic field of view, a state where working fluid is under an excessively high pressure condition and an excessively high temperature condition. Accordingly, to use a working fluid containing R1123 in an actual refrigeration cycle device, it is necessary to use the working fluid under a safe condition by suppressing a pressure condition and a temperature condition to an appropriate level. On the other hand, it is necessary to make the refrigeration cycle device exhibit a function as the refrigeration cycle device at maximum while ensuring safety.

That is, as described previously, when a working fluid is used in a high pressure and high temperature state, a disproportionation reaction is likely to occur. In view of the above, in this exemplary embodiment, a state of a working fluid containing R1123 at a suction portion of compressor 2 is intentionally set such that the working fluid exists as a two-phase fluid having high quality of vapor. For this end, a control is performed so as to prevent the working fluid from becoming an excessively high temperature at a discharge portion of compressor 2. More specifically, a control is performed so as to prevent a working fluid at the discharge portion of compressor 2 from becoming an excessively high temperature by controlling a degree of opening of expansion valve 4.

"High quality of vapor" means that a ratio of an amount of gas phase in a refrigerant in a two-phase state which is a mixed state of a gas phase and a liquid phase is high.

Hereinafter, the description is made with respect to a method of controlling expansion valve 4 when a pulse motor drive expansion valve is used as expansion valve 4.

Firstly, the description is made by taking the case where a control is performed using suction temperature detecting part 10*d* disposed at the suction portion of compressor 2 as an example.

Firstly, a temperature detected by suction temperature detecting part 10*d* and a temperature detected by evaporation temperature detecting part 10*c* are compared to each other. Based on such a comparison, it is determined whether or not a state of a working fluid is a superheated state (abnormal heat generation state) in the suction portion of compressor 2. More specifically, it is determined whether or not the difference between a suction temperature which is a detection value of suction temperature detecting part 10*d* and an evaporation temperature which is a detection value of evaporation temperature detecting part 10*c* is larger than a predetermined value (1K, for example).

Hereinafter, the case is described where a working fluid at the suction portion of compressor 2 is not in a superheated state. "The case where a working fluid is not in a superheated state" is the case where a suction state of a working fluid in the suction portion of compressor 2 is low or middle quality of vapor (the temperature difference between a suction temperature and an evaporation temperature is less than a predetermined value).

In the case of the above-mentioned state, even when a degree-of-opening pulse value of expansion valve 4 is decreased in a closing direction at the time of starting a control, there is no large change in a detection value of suction temperature detecting part 10*d*. This is because a working fluid becomes a two-phase region in the suction portion of compressor 2. That is, the two-phase region exhibits a latent heat change and hence, no temperature change occurs in a mixed refrigerant which becomes azeotropic. Accordingly, compared to a gas phase region which exhibits a sensible heat change also in a mixed refrigerant which becomes nonazeotropic, the mixed refrigerant which becomes azeotropic exhibits a small temperature change.

In view of the above, a degree-of-opening pulse value of expansion valve 4 is decreased in a closing direction until a detection value of suction temperature detecting part 10*d* is increased. When the increase of the detection value of suction temperature detecting part 10*d* starts, a degree of opening of expansion valve 4 is returned in an opening direction by approximately several pulses from a degree-of-opening pulse value (a degree of opening value of expansion valve 4). With such operations, a control of a degree of opening of expansion valve 4 is completed. As a result, a working fluid circulates with a stable refrigeration cycle.

Next, the description is made with respect to the case where a working fluid in the suction portion of compressor 2 is in a superheated state (the temperature difference between a suction temperature and an evaporation temperature being a predetermined value or more).

In the case of the above-mentioned state, when a degree-of-opening pulse value of expansion valve 4 is increased in an opening direction at the time of starting a control, a detection value of suction temperature detecting part 10*d* is decreased. This is because a working fluid is in a superheated region in the suction portion of compressor 2.

A degree-of-opening pulse value of expansion valve 4 is controlled in an opening direction until a detection value of suction temperature detecting part 10*d* becomes a fixed value. Then, a degree of opening of expansion valve 4 is increased by approximately several pulses from a pulse value at which a suction temperature of compressor 2 starts to take a fixed value. With such operations, a control of a degree of opening of expansion valve 4 is completed. As a result, a temperature of the working fluid returns to a two-phase region from a superheated region so that a stable refrigeration cycle can be realized.

Besides the above-mentioned control methods, for example, a discharge temperature detecting part (not shown) may be provided to the discharge portion of compressor 2, and a control of a superheated state of a working fluid may be performed based on a detection value of the discharge temperature detecting part.

Hereinafter, the description is made with respect to a control method based on a detection value of a discharge temperature detecting part with reference to FIG. 2.

In the above-mentioned control method, a temperature of a working fluid at the discharge part of compressor 2 is recorded preliminarily in the case where a state of the working fluid in the suction portion of compressor 2 is a two-phase fluid of high quality of vapor. More specifically, a state of a working fluid in the suction portion of compressor 2 and a target discharge temperature of compressor 2 are recorded as a set under several running conditions.

Firstly, a running condition which is closer to a preset running condition is decided based on detection values of condensation temperature detecting part 10*a* and evaporation temperature detecting part 10*c*.

Next, a target discharge temperature of compressor 2 and a detection value of the discharge temperature detecting part under the decided running condition are compared to each other.

At this stage of operation, when the detection value of the discharge temperature detecting part is higher than the target discharge temperature, it is determined that a working fluid in the suction portion of compressor 2 is in a superheated state. Then, the degree of opening of expansion valve 4 is controlled in an opening direction until the detection value of the discharge temperature detecting part assumes the target discharge temperature.

On the other hand, when the detection value of the discharge temperature detecting part is lower than the target discharge temperature, it is determined that a working fluid in the suction portion of compressor 2 is in an excessively wet state. Then, the degree of opening of expansion valve 4 is controlled in a closing direction until the detection value of the discharge temperature detecting part assumes the target discharge temperature.

With such operations, a working fluid in the suction portion of compressor 2 is introduced into a body of compressor 2 in a slightly wet state.

When the working fluid flows into compressor 2 in a slightly wet state, a temperature at the discharge portion of compressor 2 is lowered to Tdis2 from Tdis1 on isothermal line 8 shown in FIG. 2. Accordingly, an excessive temperature increase of the working fluid can be suppressed so that the occurrence of a disproportionation reaction can be suppressed.

As described above, a superheated state of a working fluid can be controlled based on a detection value of the discharge temperature detecting part.

Further, in this exemplary embodiment, when a temperature detection value of condensation temperature detecting part 10*a* becomes excessively large, a control may be performed where a pressure and a temperature of a working fluid on a high pressure side in refrigeration cycle device 1 is lowered by opening expansion valve 4.

A method of controlling a refrigeration cycle device based on a temperature detection value of the condensation temperature detecting part 10*a* is described hereinafter with reference to FIG. 3.

Figure 3:
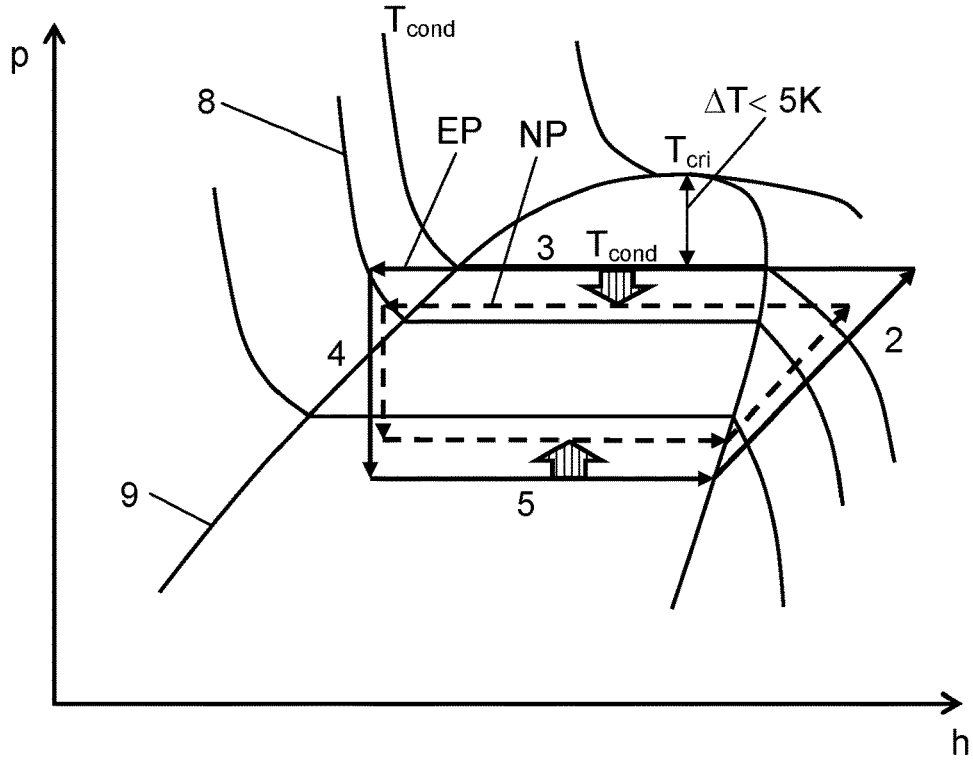
FIG. 3 is a Mollier chart for describing an operation of the refrigeration cycle device according to the first exemplary embodiment of the present invention.

FIG. 3 is a Mollier chart for describing an operation of the refrigeration cycle device according to the first exemplary embodiment of the present invention. EP indicated by a solid-line arrow in the drawing indicates a refrigeration cycle under an excessively large pressure condition which becomes a cause of the occurrence of a disproportionation reaction. In the same manner, NP indicated by a broken-line arrow in the drawing indicates a refrigeration cycle under normal running of refrigeration cycle device 1.

In general, with respect to refrigerants other than carbon dioxide, it is necessary to work a working fluid in a state where a temperature of the working fluid does not reach a supercritical condition which goes beyond a critical point indicated by $T_{cri}$ in FIG. 3. This is because a substance assumes a state which is neither a gas nor a liquid in a supercritical state and hence, the behavior of the substance becomes unstable and active whereby a control of the refrigeration cycle becomes difficult.

Accordingly, in the above-mentioned control method, using a temperature at a critical point (critical temperature) as a rough target, a degree of opening of expansion valve 4 is controlled such that a condensation temperature does not fall within a preset value (for example, 5K) from the critical temperature. For example, when a working fluid (mixed refrigerant) containing R1123 is used, a control is performed so as to set a temperature of the working fluid lower than the critical temperature by −5° C.

That is, as indicated by EP in FIG. 3, when a temperature value detected by condensation temperature detecting part 10*a* disposed in a two-phase pipe of condenser 3 falls within 5K with respect to a critical temperature preliminarily stored in a controller, a degree of opening of expansion valve 4 is controlled on a side where expansion valve 4 is opened. With such a control, for example, as indicated by NP in FIG. 3, a condensation pressure on a high pressure side of refrigeration cycle device 1 is lowered. As a result, a disproportionation reaction which occurs due to the excessive increase of a refrigerant pressure can be suppressed. Further, even when a disproportionation reaction occurs, the increase of a pressure on a high pressure side of refrigeration cycle device 1 can be suppressed.

In the above-mentioned control method, a pressure in condenser 3 is indirectly grasped based on a condensation temperature measured by condensation temperature detecting part 10*a*, and a degree of opening of expansion valve 4 is controlled. That is, a condensation temperature is used as an index in place of a condensation pressure. Accordingly, the above-mentioned method is preferable as a control method when a working fluid containing R1123 is azeotropic or pseudo azeotropic so that there is no temperature difference or a little temperature difference (temperature gradient) between a dew point and a boiling point of a working fluid containing R1123 in condenser 3.

<Modification 1>

In the above-mentioned exemplary embodiment, the explanation has been made by taking the control method where expansion valve 4 or the like is indirectly controlled by comparing a critical temperature and a condensation temperature as an example. However, the present invention is not limited to such a control method. For example, a control of a degree of opening of expansion valve 4 may be performed based on a directly measured pressure.

Hereinafter, modification 1 of the control of a degree of opening of expansion valve 4 according to this exemplary embodiment is described with reference to FIG. 4.

Figure 4:
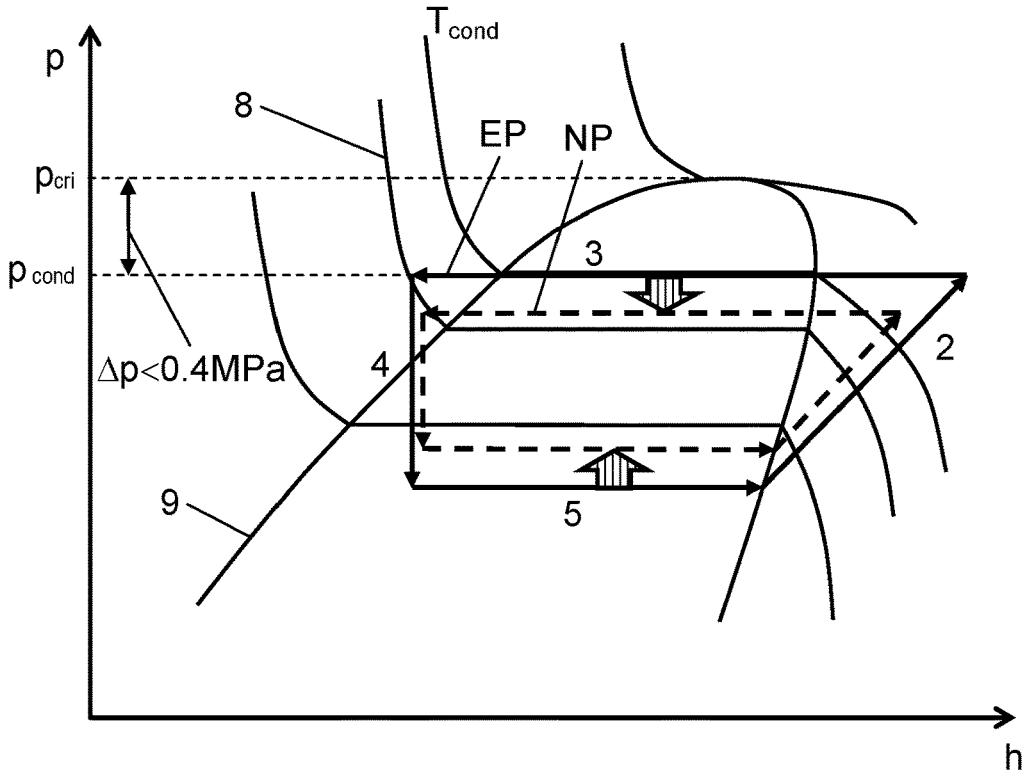
FIG. 4 is a Mollier chart for describing an operation of the refrigeration cycle device according to the first exemplary embodiment of the present invention.

FIG. 4 is a Mollier chart for describing an operation of the refrigeration cycle device according to the first exemplary embodiment of the present invention. EP indicated by a solid-line arrow in the drawing indicates a refrigeration cycle where the excessive pressure increase is underway in a range from the discharge portion of compressor 2 to the inlet of expansion valve 4 through condenser 3. In the same manner, NP indicated by a broken-line arrow in the drawing indicates a refrigeration cycle in a state where the refrigeration cycle escapes from an excessive pressure state indicated by EP.

In the control method according to modification 1, as shown in FIG. 4, during running of refrigeration cycle device 1, a control is performed based on pressure difference obtained by subtracting, for example, condenser outlet pressure $P_{cond}$ detected by high-pressure-side pressure detecting part 15*a* from a pressure at critical point (critical pressure) $P_{cri}$ preliminarily stored in the controller.

That is, when the pressure difference obtained by subtracting condenser outlet pressure $P_{cond}$ from pressure at a critical point (critical pressure) $P_{cri}$ becomes smaller than a preset value (for example, $\Delta p$=0.4 MPa) as indicated by EP in FIG. 4, it is determined that a disproportionation reaction has occurred or a possibility of occurrence of a disproportionation reaction is high in a working fluid containing R1123 in a range from outlet 2*b* of compressor 2 to inlet 4*a* of expansion valve 4. Based on such determination, the controller controls a degree of opening of expansion valve 4 on a side where expansion valve 4 is opened so as to avoid the continuation of running under the above-mentioned high pressure condition.

With such operations, the refrigeration cycle in FIG. 4 is operated on a side where a high pressure (condensation pressure) is lowered as indicated by NP in the drawing. As a result, a disproportionation reaction of a working fluid can be suppressed or the pressure increase which occurs after a disproportionation reaction can be suppressed.

It is preferable to use the control method according to modification 1 in the case where a working fluid containing R1123 is used at a mixing ratio which brings about nonazeotropic, and more particularly, in the case where a condensation pressure exhibits a large temperature gradient. That is, a mixed refrigerant which becomes nonazeotropic causes a temperature change in a two-phase region and hence, it is difficult to estimate a pressure based on a temperature. Accordingly, it is desirable to directly detect a pressure.

<Modification 2>

A degree of opening of expansion valve 4 may be controlled based on a degree of supercooling.

Hereinafter, modification 2 of the control of a degree of opening of expansion valve 4 according to this exemplary embodiment is described with reference to FIG. 5.

Figure 5:
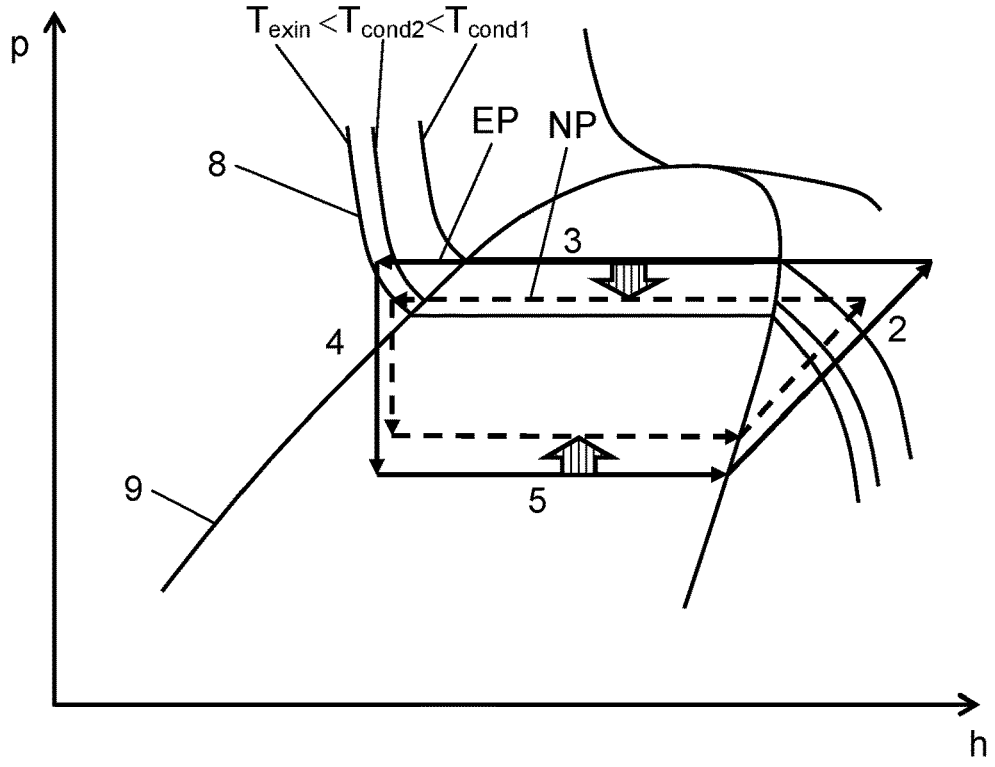
FIG. 5 is a Mollier chart for describing an operation of the refrigeration cycle device according to the first exemplary embodiment of the present invention.

FIG. 5 is a Mollier chart for describing an operation of the refrigeration cycle device according to the first exemplary embodiment of the present invention. EP indicated by a solid-line arrow in the drawing indicates a refrigeration cycle under an excessively large pressure condition which becomes a cause of the occurrence of a disproportionation reaction. In the same manner, NP indicated by a broken-line arrow in the drawing indicates a refrigeration cycle under normal running of refrigeration cycle device 1.

In general, in a refrigeration cycle device, a temperature of a refrigerant in condenser 3 is set higher than a temperature of a surrounding medium by a fixed temperature by properly controlling a refrigeration cycle formed of an expansion valve, a compressor and the like and by properly setting a size of a heat exchanger and a refrigerant filling amount. In this case, a degree of supercooling is set to a value of approximately 5K in general. Accordingly, the substantially same measures are taken with respect to a working fluid containing R1123 used in the refrigeration cycle device having substantially the same configuration.

In the case of the refrigeration cycle device where supercooling is set as described above, when a refrigerant pressure is excessively increased, for example, a degree of supercooling at the inlet of expansion valve 4 is increased as indicated by EP shown in FIG. 5.

In view of the above, a degree of opening of expansion valve 4 is controlled with reference to a degree of supercooling of a refrigerant at the inlet of expansion valve 4 in modification 2.

More specifically, a degree of supercooling of a refrigerant at the inlet of expansion valve 4 at the time of normal running of the refrigeration cycle is estimated as 5K, for example. Then, a degree of opening of expansion valve 4 is controlled using 15K which is three times as large as the estimated value as a rough target. The reason the degree of supercooling which is a threshold value is set three times as large as the estimated value is that there is a possibility that a range of degree of supercooling changes.

Hereinafter, a specific control method according to modification 2 is described.

Firstly, a degree of supercooling is calculated based on a detection value of condensation temperature detecting part 10*a* and a detection value of condenser exit temperature detecting part 10*b*. The degree of supercooling is a value obtained by subtracting a detection value of condenser exit temperature detecting part 10*b* from a detection value of condensation temperature detecting part 10*a*.

Next, the controller determines whether or not a degree of supercooling at the inlet of expansion valve 4 reaches a preset set value (15K). When a degree of supercooling reaches the set value, expansion valve 4 is operated in a direction that a degree of opening of expansion valve 4 is increased. With such operations, as indicated by a shift from EP to NP in FIG. 5, a control is performed in a direction that a condensation pressure which is a high pressure portion in refrigeration cycle device 1 is lowered. Lowering of the condensation pressure is equal to lowering of a condensation temperature. That is, the condensation temperature indicated by isothermal line 8 is lowered to Tcond2 from Tcond1. Accordingly, a degree of supercooling at the inlet of expansion valve 4 is decreased to Tcond2-Texin from Tcond1-Texin. At this stage of operation, a temperature of a working fluid at the inlet of expansion valve 4 is fixed to Texin.

As described above, along with lowering of a condensation pressure in refrigeration cycle device 1, a degree of supercooling is also lowered. Accordingly, with the use of the control method according to modification 2, it is possible to control a condensation pressure in refrigeration cycle device 1 with reference to a degree of supercooling.

<Modification 3>

A degree of opening of expansion valve 4 may be controlled based on pressure difference between a high pressure and a low pressure.

Hereinafter, modification 3 of the control of a degree of opening of expansion valve 4 according to this exemplary embodiment is described with reference to FIG. 6.

Figure 6:
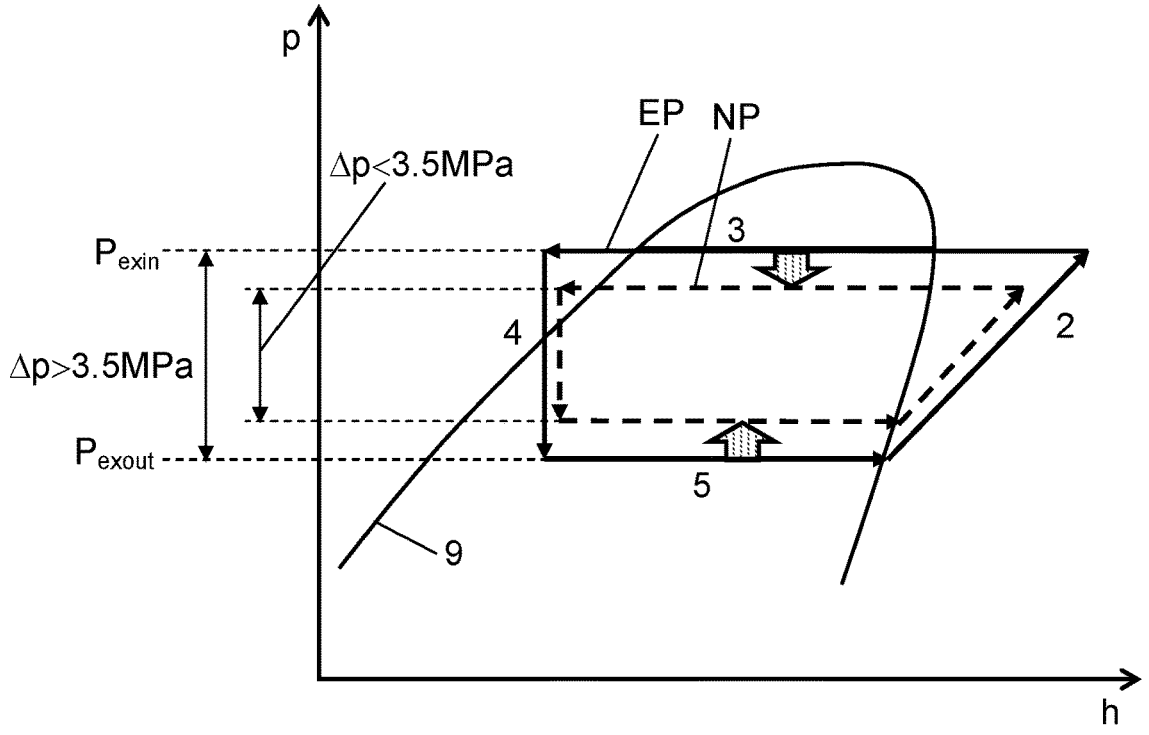
FIG. 6 is a Mollier chart for describing an operation of the refrigeration cycle device according to the first exemplary embodiment of the present invention.

FIG. 6 is a Mollier chart for describing an operation of the refrigeration cycle device according to the first exemplary embodiment of the present invention. In the drawing, EP indicated by a solid-line arrow indicates a refrigeration cycle where a pressure of a working fluid on a high pressure side (condensation side) in refrigeration cycle device 1 is excessively increased. In the same manner, NP indicated by a broken-line arrow in the drawing indicates a refrigeration cycle under normal running of refrigeration cycle device 1.

As shown in FIG. 1, refrigeration cycle device 1 according to this exemplary embodiment is configured such that the measurement of a pressure of a working fluid containing R1123 can be performed by high-pressure-side pressure detecting part 15*a* and low-pressure-side pressure detecting part 15*b* disposed at inlet 4*a* and outlet 4*b* of expansion valve 4, respectively.

At this stage of operation, in the case where there is no change in an input to compressor 2 and modes (states) of surrounding mediums, by throttling a degree of opening of expansion valve 4, a pressure of working fluid containing R1123 on a high pressure side in refrigeration cycle device 1, that is, a pressure of a working fluid in condenser 3 is increased, and a pressure on a low pressure side (on an evaporator 5 side) is lowered.

As described previously, a condition that a disproportionation reaction of a working fluid is likely to occur is the case where an intermolecular distance between refrigerant molecules is short so that molecular movement is active. Particularly, a possibility that a disproportionation reaction occurs most is increased in condenser 3 where a working fluid becomes a high pressure.

In view of the above, in modification 3, a control is performed so as to prevent excessive pressure increase of a working fluid thus preventing the occurrence of a disproportionation reaction. A control is also performed such that even when a disproportionation reaction occurs so that the pressure increase occurs, excessive pressure increase in refrigeration cycle device 1 is alleviated.

That is, when excessive pressure increase occurs in a working fluid, as shown in FIG. 6, refrigeration cycle device 1 is operated in a direction that pressure difference between a high pressure side and a low pressure side (difference between a high pressure and a low pressure) in compressor 2 is increased. In view of the above, in modification 3, when the pressure difference becomes a fixed value (preset determined value) or more, the controller controls a degree of opening of expansion valve 4 in a direction that the degree of opening is increased. With such a control, pressure increase due to a disproportionation reaction of a working fluid is alleviated. Alternatively, the controller performs a control such that a refrigerant pressure is constantly lowered to a level that a disproportionation reaction of a working fluid does not occur.

In modification 3, as an index used in a control of a degree of opening of expansion valve 4, a pressure difference between inlet 4*a* and outlet 4*b* of expansion valve 4 is set to 3.5 MPa, for example. This set value is a value smaller than a pressure difference which has a possibility of causing the occurrence of a disproportionation reaction in a working fluid. This set value is a pressure difference set by taking into account also an evaporation pressure difference and a condensation pressure difference when refrigeration cycle device 1 is used in air conditioning, hot water heating or freezing and refrigeration. Accordingly, when it is unnecessary to take into account the above-mentioned contents, it is not particularly necessary to limit the pressure difference between inlet 4*a* and outlet 4*b* of expansion valve 4 to the above-mentioned set value.

It is preferable to use the control method according to modification 3 when refrigeration cycle device 1 is used at a mixing ratio that a working fluid containing R1123 becomes nonazeotropic, and more particularly in the case where a temperature gradient is large in a condensation pressure.

<Modification4>

Hereinafter, modification 4 of the control of a degree of opening of expansion valve 4 according to this exemplary embodiment is described with reference to FIG. 7.

Modification 4 differs from modification 3 with respect to a point that a pressure difference between a high pressure and a low pressure is estimated based on a condensation temperature and an evaporation temperature.

Figure 7:
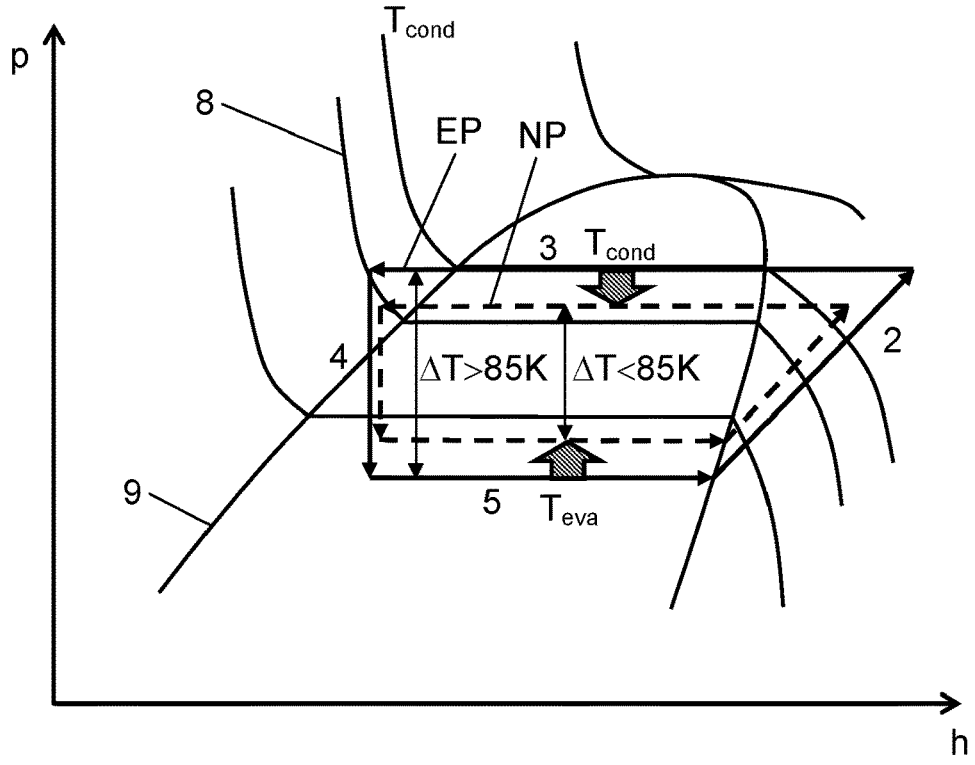
FIG. 7 is a Mollier chart for describing an operation of the refrigeration cycle device according to the first exemplary embodiment of the present invention.

FIG. 7 is a Mollier chart for describing an operation of the refrigeration cycle device according to the first exemplary embodiment of the present invention. In the drawing, EP indicated by a solid-line arrow indicates a refrigeration cycle where a pressure of a working fluid on a high pressure side in the refrigeration cycle device is excessively increased. In the same manner, NP indicated by a broken-line arrow in the drawing indicates a refrigeration cycle under normal running of refrigeration cycle device 1.

That is, in general, a pressure of a working fluid can be estimated by measuring a temperature of the working fluid. Accordingly, in modification 4, a control is performed by measuring a temperature difference in place of direct measurement of a pressure difference.

As described previously, a state where a disproportionation reaction has occurred or there is a possibility that a disproportionation reaction occurs is the case where a pressure of a working fluid in refrigeration cycle device 1 is excessively increased.

Accordingly, a condensation temperature and an evaporation temperature which are detection values of condensation temperature detecting part 10*a* and evaporation temperature detecting part 10*c* are measured respectively. Then, a degree of opening of expansion valve 4 is controlled based on a temperature difference between the detected condensation temperature and the detected evaporation temperature.

More specifically, when the temperature difference between the detected condensation temperature and the detected evaporation temperature is larger than a preset fixed value (85K, for example), expansion valve 4 is controlled in a direction that a degree of opening is increased.

In modification 4, as an index of a temperature difference used in a control of a degree of opening of expansion valve 4, for example, 85K is set. This set value is, in the same manner as modification 3, a value smaller than a temperature difference which has a possibility of causing the occurrence of a disproportionation reaction in a working fluid. This set value is a temperature set by taking into account also a temperature difference between an evaporation temperature and a condensation temperature when refrigeration cycle device 1 is used in air conditioning, hot water heating or freezing and refrigeration. Accordingly, when it is unnecessary to take into account the above-mentioned contents, it is not particularly necessary to limit the temperature difference between the detected condensation temperature and the detected evaporation temperature to the above-mentioned set value.

Further, the control method according to modification 4 is a mode where a pressure difference of a refrigerant is indirectly measured by measuring a temperature difference. Accordingly, it is desirable to use a working fluid containing R1123 at a mixing ratio where the working fluid becomes azeotropic or pseudo azeotropic having no temperature gradient in condenser 3. That is, a temperature change occurs in a two-phase region in a mixed refrigerant which becomes nonazeotropic and hence, it is difficult to estimate a pressure based on a temperature. Accordingly, it is desirable to use a working fluid at a mixing ratio where the working fluid becomes azeotropic or pseudo azeotropic.

As has been described heretofore, the refrigeration cycle device according to this exemplary embodiment can be stably operated by effectively controlling a working fluid containing R1123 where a disproportionation reaction is likely to occur.

The configuration of a pipe joint of refrigeration cycle device 1 according to this exemplary embodiment is described with reference to FIG. 8.

Figure 8:
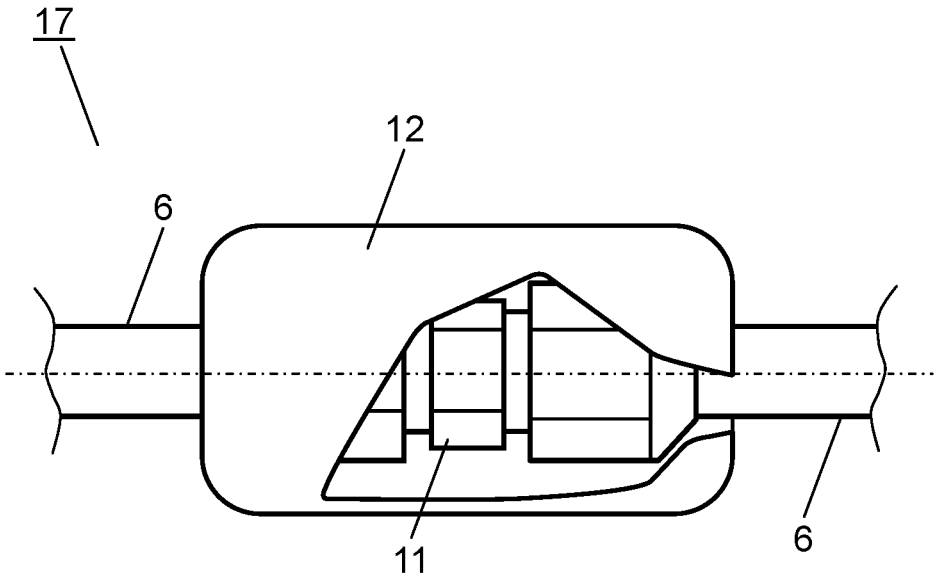
FIG. 8 is a schematic constitutional view of a pipe joint forming a part of the refrigeration cycle device according to the first exemplary embodiment of the present invention.

FIG. 8 is a schematic constitutional view of a pipe joint forming a part of the refrigeration cycle device according to the first exemplary embodiment of the present invention.

Refrigeration cycle device 1 according to this exemplary embodiment is used in a split-type air conditioner (air conditioning unit) for household use and the like, for example. In this case, the air conditioner includes an outdoor unit having an outdoor heat exchanger, and an indoor unit having an indoor heat exchanger. Usually, the outdoor unit and the indoor unit of the air conditioner cannot be structurally integrally formed. Accordingly, the outdoor unit and the indoor unit are directly connected to each other at an installation place using a mechanical pipe joint such as flare type union 11 shown in FIG. 8, for example.

There may be a case where a connection state of a mechanical pipe joint becomes defective due to an error or the like during an operation. When the connection state becomes defective, for example, a refrigerant leaks from a portion of the joint and adversely affects performances of equipment such as refrigeration cycle device 1. Further, a working fluid per se containing R1123 is a greenhouse effect gas having a global warming effect. Accordingly, when the working fluid leaks, there is a possibility that the leaked working fluid adversely affects a global environment.

In view of the above, refrigeration cycle device 1 according to this exemplary embodiment includes pipe joint 17 with which leakage of a refrigerant can be rapidly detected and a repair can be performed.

Usually, leakage of a refrigerant is detected by a detecting method where, for example, a detecting agent or the like is applied to a portion of a mechanical pipe joint or the like by coating and leakage of a refrigerant is detected based on the generation of bubbles or by a detecting sensor. However, the above-mentioned both detecting methods require considerable time and efforts and hence, these detecting methods are not efficient.

In view of the above, this exemplary embodiment adopts the configuration where seal 12 impregnated with a polymerization accelerator is wrapped around an outer periphery of flare type union 11. With such a configuration, the detection of leakage of a refrigerant can be performed easily, and a leakage amount of the refrigerant can be reduced.

More specifically, in case of a working fluid containing R1123, this exemplary embodiment makes use of a fact that a polymer product such as polytetrafluoroethylene which is one of fluorocarbon resins is generated by a polymerization reaction. That is, seal 12 is wrapped around the outer periphery of flare type union 11, and a working fluid containing R1123 and a polymerization accelerator are intentionally brought into contact with each other at a leakage portion. Accordingly, at the leakage portion where a refrigerant leaks, polytetrafluoroethylene is precipitated and solidified. As a result, leakage of the refrigerant can be visually detected. That is, a time necessary for finding of leakage of a refrigerant and repair can be largely shortened.

A portion where the precipitation and solidifying of polytetrafluoroethylene occur is a portion where a working fluid containing R1123 leaks. Accordingly, a leaked amount of a refrigerant can be suppressed by a polymerization product generated and adhered to the portion for preventing leakage.

(Second Exemplary Embodiment)

A refrigeration cycle device according to a second exemplary embodiment of the present invention is described with reference to FIG. 9.

Figure 9:
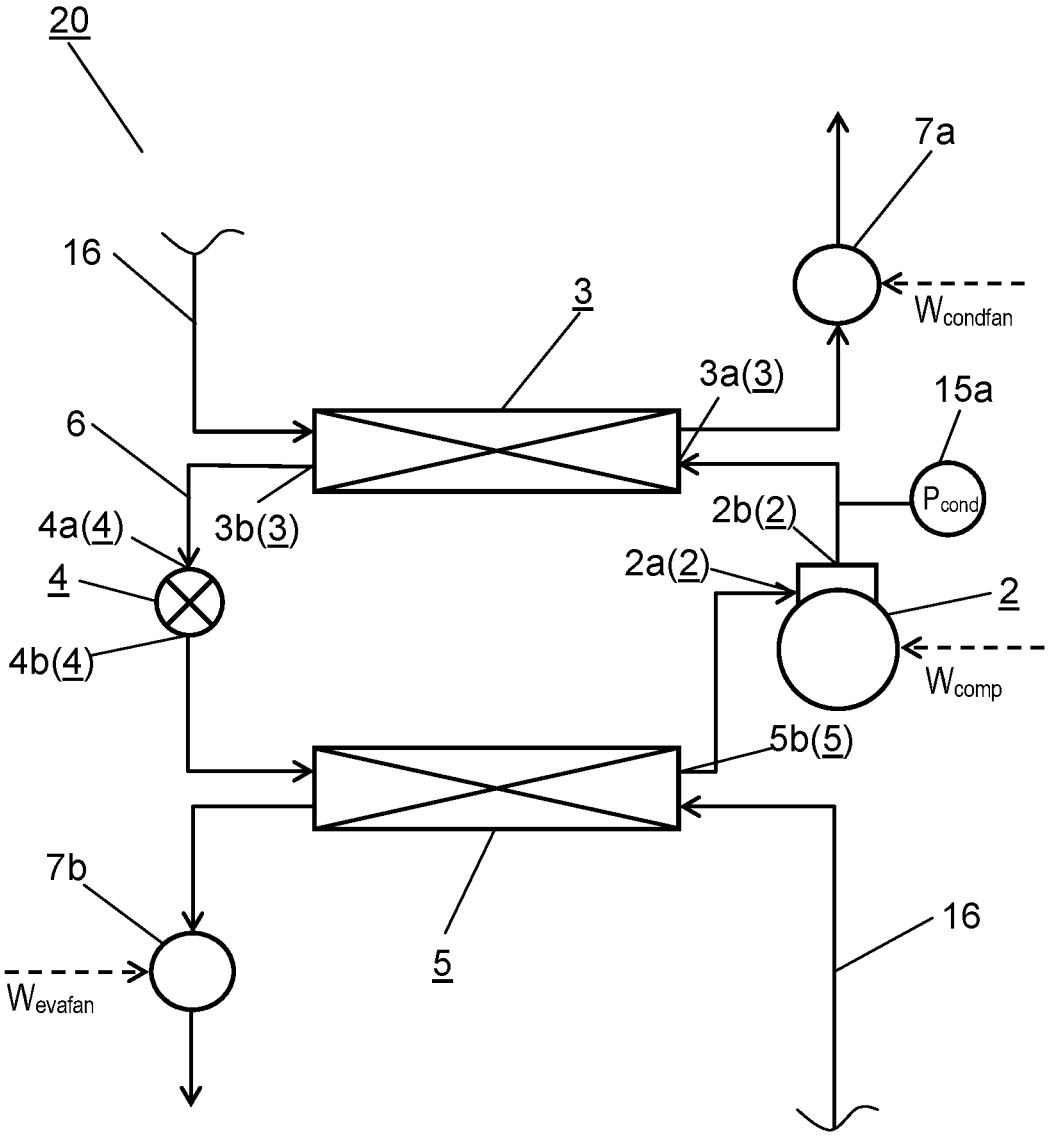
FIG. 9 is a schematic constitutional view of a refrigeration cycle device according to a second exemplary embodiment of the present invention.

FIG. 9 is a schematic constitutional view of the refrigeration cycle device according to the second exemplary embodiment of the present invention.

As shown in FIG. 9, refrigeration cycle device 20 according to this exemplary embodiment differs from refrigeration cycle device 1 according to the first exemplary embodiment with respect to a point that high-pressure-side pressure detecting part 15*a* is disposed between a discharge portion of compressor 2 and an inlet of condenser 3. Other constitutions and operations of refrigeration cycle device 20 of this exemplary embodiment are equal to corresponding constitutions and operations of refrigeration cycle device 1 of the first exemplary embodiment and hence, the description of such other constitutions and operations is omitted.

As shown in FIG. 9, to consider a flow direction of a working fluid, a place where the working fluid exhibits the highest pressure value in refrigeration cycle device 20 is the discharge portion of compressor 2 immediately after the working fluid is pressurized by compressor 2.

That is, according to this exemplary embodiment, a degree of opening of expansion valve 4 can be controlled with reference to a pressure value generated after a cause which generates a disproportionation reaction or a disproportionation reaction occurs, that is, a pressure at a maximum pressure point in refrigeration cycle device 20. With such a configuration, the degree of opening of expansion valve 4 can be controlled with further accuracy.

(Third Exemplary Embodiment)

A refrigeration cycle device according to a third exemplary embodiment of the present invention is described hereinafter with reference to FIG. 10.

Figure 10:
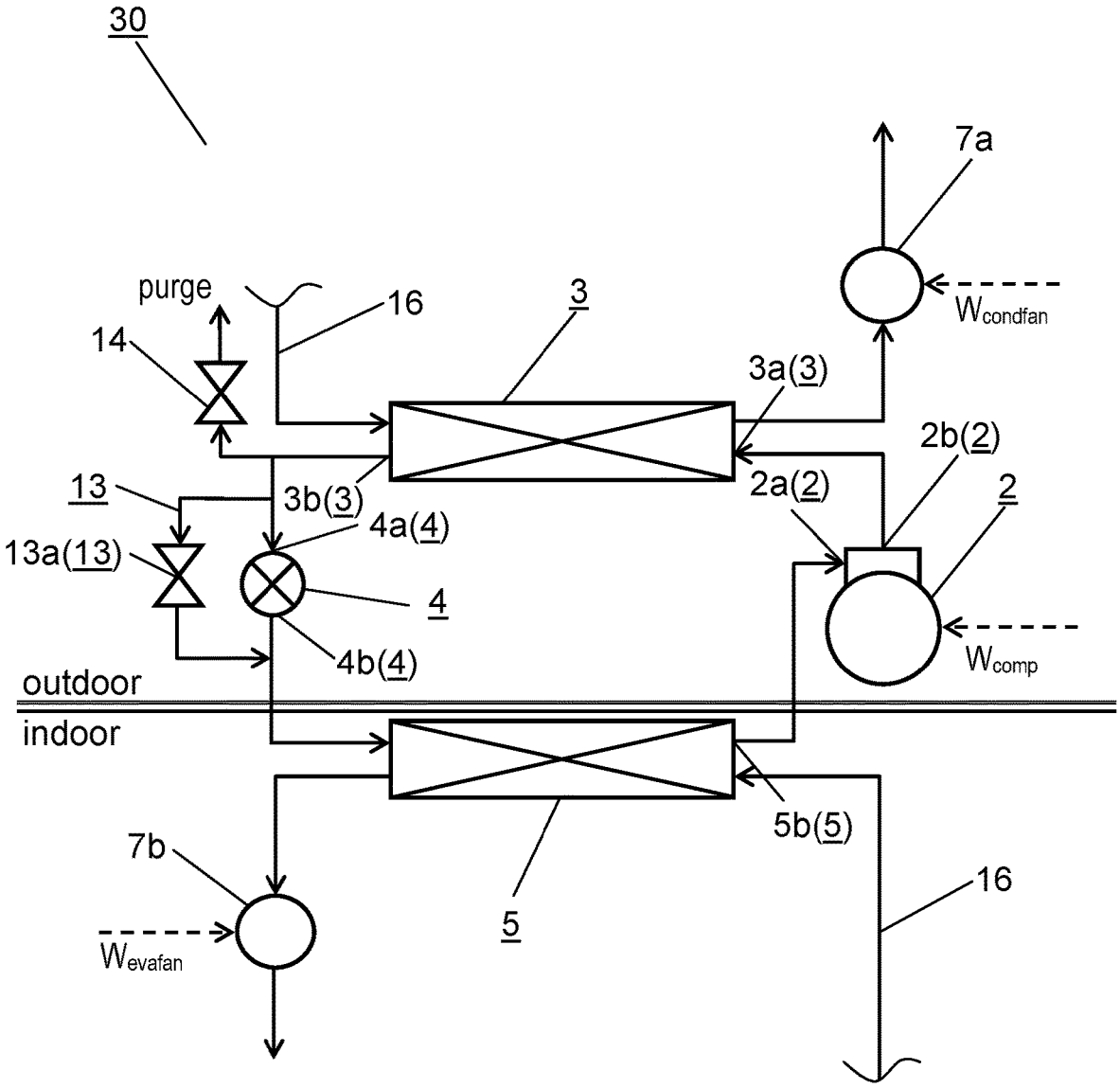
FIG. 10 is a schematic constitutional view of a refrigeration cycle device according to a third exemplary embodiment of the present invention.

FIG. 10 is a schematic constitutional view of the refrigeration cycle device according to the third exemplary embodiment of the present invention.

As shown in FIG. 10, refrigeration cycle device 30 according to this exemplary embodiment further includes bypass flow passage 13 which includes bypass open/close valve 13*a* connected to inlet 4*a* and outlet 4*b* of expansion valve 4. Further, refrigeration cycle device 30 of this exemplary embodiment differs from refrigeration cycle device 1 according to the first exemplary embodiment with respect to a point that a purge line which has relief valve 14 forming an atmosphere open portion is provided between outlet 3*b* of condenser 3 and inlet 4*a* of expansion valve 4. In this case, an open side of relief valve 14 is disposed outdoors. In FIG. 10, the description of condensation temperature detecting part 10*a*, condenser exit temperature detecting part 10*b*, evaporation temperature detecting part 10*c*, suction temperature detecting part 10*d*, high-pressure-side pressure detecting part 15*a*, low-pressure-side pressure detecting part 15*b* all of which are described with reference to FIG. 1 is omitted.

That is, even when a degree of opening of expansion valve 4 is controlled at a full open state using various control methods described in the first exemplary embodiment, there is a case where a refrigerant does not have two phases at the suction portion of the compressor so that a pressure of a working fluid is not lowered or a case where a situation that requires the acceleration of a lowering speed of a pressure takes place.

In view of the above, according to this exemplary embodiment, even when the above-mentioned situation takes place, bypass open/close valve 13*a* provided to bypass flow passage 13 is opened so that a refrigerant is made to flow through bypass flow passage 13. Accordingly, a pressure of a working fluid on a high pressure side is rapidly lowered. As a result, breaking of refrigeration cycle device 30 can be suppressed in advance.

Further, in this exemplary embodiment, when a refrigerant does not have two phases at the suction portion of the compressor, a control for stopping compressor 2 in emergency may be performed in addition to a control for increasing a degree of opening of expansion valve 4 (for example, a full-opened state) and a control of bypass open/close valve 13*a* disposed in bypass flow passage 13. With such a configuration, breaking of refrigeration cycle device 30 can be prevented more effectively. When compressor 2 is stopped in emergency, it is desirable that fluid machine 7*a* which forms the first conveyance part or fluid machine 7*b* which forms the second conveyance portion be not stopped. In this case, a pressure of a working fluid on a high pressure side can be rapidly lowered by dissipating heat of a working fluid.

In this case, when a disproportionation reaction is not suppressed so that a refrigerant does not have two phases at the suction portion of the compressor in a condition described below although the above-mentioned measure is taken, a working fluid is purged using above-mentioned relief valve 14.

That is, the above-mentioned case is the case where the difference between a critical temperature of a working fluid and a condensation temperature detected by condensation temperature detecting part 10*a* is less than 5K. Further, the above-mentioned case is the case where the difference between a critical pressure of a working fluid and a pressure detected by high-pressure-side pressure detecting part 15*a* is less than 0.4 MPa. In these cases, there is a possibility that a refrigerant pressure in refrigeration cycle device 30 is increased. Accordingly, it is necessary to prevent breaking of refrigeration cycle device 30 by releasing a refrigerant having a high pressure to the outside.

In view of the above, in this exemplary embodiment, relief valve 14 which purges a working fluid containing R1123 in refrigeration cycle device 30 to an external space is opened. With such an operation, a refrigerant having a high pressure is released to the outside and hence, breaking of refrigeration cycle device 30 can be prevented with more certainty.

It is preferable that relief valve 14 be installed on a high pressure side of refrigeration cycle device 30. It is also preferable that relief valve 14 be installed in a range from outlet 3*b* of condenser 3 to inlet 4*a* of expansion valve 4 described in this exemplary embodiment. This is because a working fluid assumes a high-pressure supercooled liquid state at this position and hence, a steep pressure increase is likely to occur following a disproportionation reaction of a working fluid. This steep pressure increase is likely to generate water hammer. "Water hammer" is a phenomenon (action) where a pressure wave is generated along with the sharp pressure increase caused by a disproportionation reaction in a refrigerant, reaches a remote portion without being attenuated, and generates a high pressure portion at the portion which the pressure wave reaches. Accordingly, there is a possibility that a circuit member is broken due to water hummer. In view of the above, breaking of refrigeration cycle device 30 is suppressed by providing relief valve 14 at such a position.

It is particularly desirable that relief valve 14 be installed in a range from the discharge portion of compressor 2 to inlet 3*a* of condenser 3. It is because a working fluid exists in a gas state of high temperature and high pressure at this position. Accordingly, molecular movement of a working fluid is active and hence, a disproportionation reaction is likely to occur. In view of the above, relief valve 14 is provided at such a position thus suppressing the occurrence of a disproportionation reaction with certainty.

Relief valve 14 is also provided on an outdoor unit side. This is because in case of an air conditioner, a discharge of a working fluid into a living space on an indoor side can be prevented. In case of a freezing and refrigeration unit, a discharge of a working fluid toward an article display side of a display case or the like can be prevented. That is, relief valve 14 is provided by taking into account that a working fluid does not directly affect a person or an article.

In case of this exemplary embodiment, it is further desirable from a viewpoint of safety that refrigeration cycle device 30 be stopped by turning off a power source, for example, as soon as relief valve 14 is opened. With such a configuration, a possibility that an electric part in the outdoor unit becomes an ignition source is lowered.

(Fourth Exemplary Embodiment)

Hereinafter, the description is made with respect to a refrigeration cycle device according to a fourth exemplary embodiment of the present invention with reference to FIG. 11 and FIG. 12.

Figure 11:
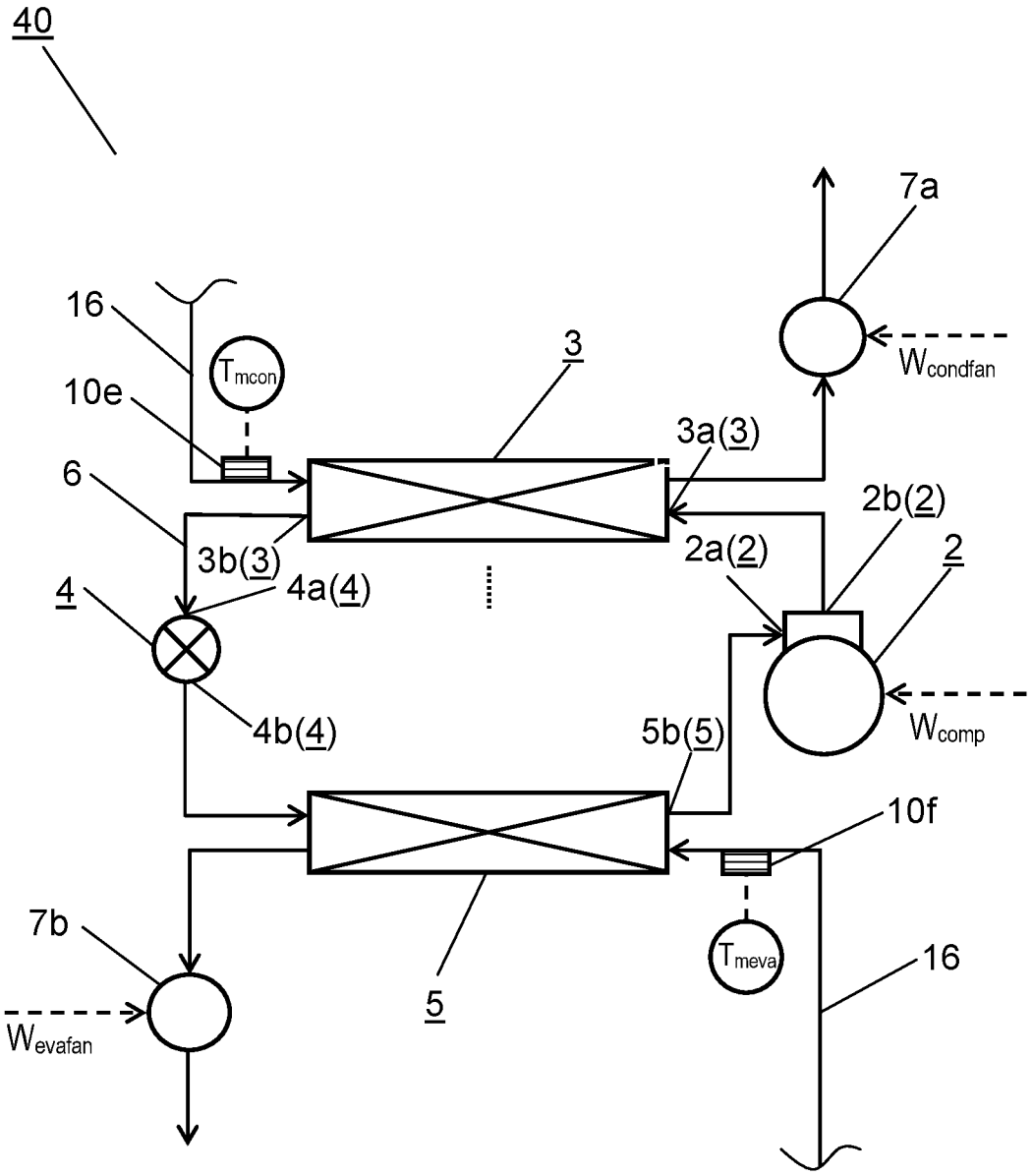
FIG. 11 is a schematic constitutional view of a refrigeration cycle device according to a fourth exemplary embodiment of the present invention.

FIG. 11 is a schematic constitutional view of the refrigeration cycle device according to the fourth exemplary embodiment of the present invention.

As shown in FIG. 11, in refrigeration cycle device 40 according to the fourth exemplary embodiment, first medium temperature detecting part 10*e* for detecting a temperature of the surrounding medium which is a first medium before the surrounding medium enters condenser 3 and second medium temperature detecting part 10*f* for detecting a temperature of the surrounding medium which is a second medium before the surrounding medium enters evaporator 5 are disposed in fluid passages 16 of the respective surrounding mediums. Refrigeration cycle device 40 according to the fourth exemplary embodiment differs from refrigeration cycle device 1 according to the first exemplary embodiment with respect to a point that detection values of condensation temperature detecting part 10*a*, condenser exit temperature detecting part 10*b*, evaporation temperature detecting part 10*c*, suction temperature detecting part 10*d*, first medium temperature detecting part 10*e*, second medium temperature detecting part 10*f*, high-pressure-side pressure detecting part 15*a*, and low-pressure-side pressure detecting part 15*b* and input power values of compressor 2 and fluid machines 7*a*, 7*b* are recorded in an electronic recording device (not shown) for a fixed time.

Figure 12:
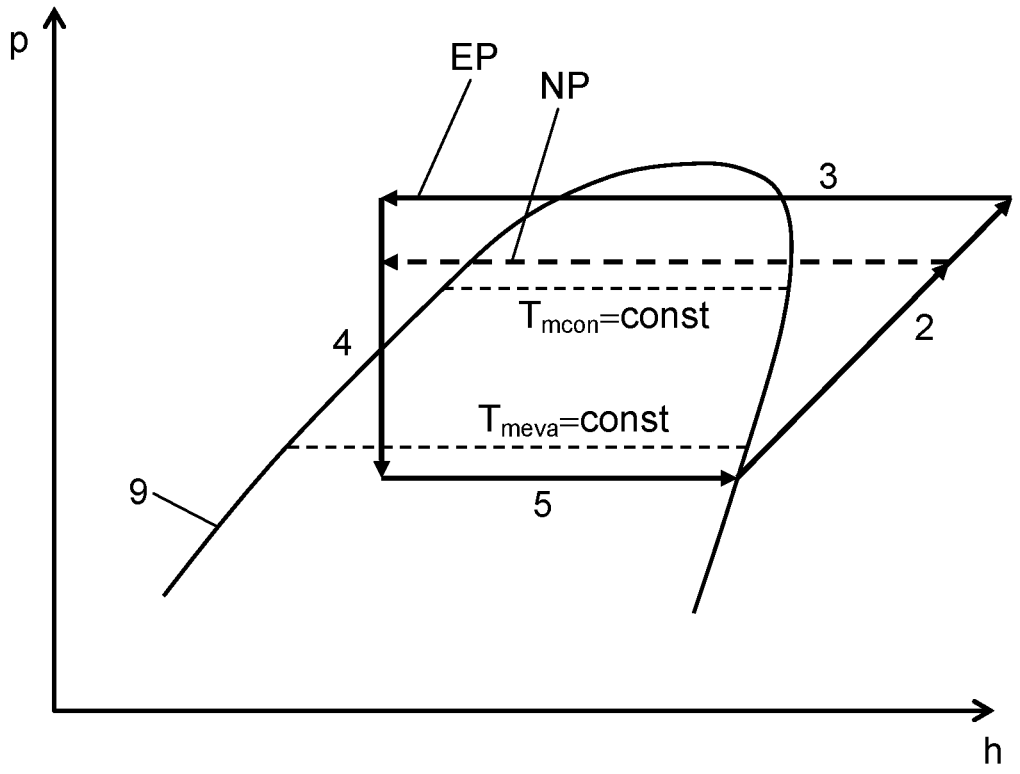
FIG. 12 is a Mollier chart for describing an operation of the refrigeration cycle device according to the fourth exemplary embodiment of the present invention.

Further, FIG. 12 is a Mollier chart for describing an operation of the refrigeration cycle device according to the fourth exemplary embodiment of the present invention. An EP line indicated by a solid-line arrow in the drawing indicates a refrigeration cycle of a condensation pressure when a disproportionation reaction occurs in the refrigeration cycle. In the same manner, an NP line indicated by a broken-line arrow in the drawing indicates a refrigeration cycle in normal running of refrigeration cycle device 40. In this case, a cycle change when the condensation pressure is increased (for example, difference between an evaporation pressure of NP and an evaporation pressure of EP and the like) is omitted in FIG. 12 to facilitate the description.

The following four reasons are considered as reasons that a condensation temperature of a working fluid containing R1123 which is measured by a two-phase pipe disposed in condenser 3 is rapidly increased. That is, (1) rapid increase of surrounding medium temperatures Tmcon, Tmeva, (2) a pressure boosting action generated due to the increase of power supplied to compressor 2, (3) a change of flow of surrounding medium (the increase of power supplied to either one of fluid machines 7*a*, 7*b* which drive the surrounding mediums) and the like. As a factor specific to a working fluid containing R1123, (4) a pressure boosting action generated by a disproportionation reaction or the like is named.

In this exemplary embodiment, a degree of opening of expansion valve 4 is controlled after it is determined that none of the above-mentioned phenomena (1) to (3) has occurred. These phenomena specify that a disproportionation reaction has occurred in a working fluid.

That is, in this exemplary embodiment, when a change amount of condensation temperature of a working fluid containing R1123 is large compared to a change amount of temperature or a change amount of input power in the above-mentioned (1) to (3), a control is performed so as to increase a degree of opening of expansion valve 4.

Hereinafter, a specific control method of this exemplary embodiment is described.

It is usually difficult to compare a change amount of temperature and a change amount of input power value under the same criteria. Accordingly, in the measurement of a change amount of temperature, while performing a control such that input power is not changed, a change amount of temperature is measured. That is, a change amount of temperature is measured while maintaining the number of rotation of a motor, for example, which forms a part of compressor 2 or fluid machine 7*a*, 7*b* to a fixed value.

A change amount of temperature is measured in a state described above at predetermined time intervals of 10 seconds to 1 minute, for example. More specifically, firstly, compressor 2 and fluid machines 7*a*, 7*b* are driven while maintaining input power amounts to fixed values from a point of time before a change amount of temperature is measured (for example, 10 seconds to 1 minute). Due to such an operation, change amounts of input power amounts per unit time of compressor 2 and fluid machines 7*a*, 7*b* become substantially zero. "A change amount of input power amount per unit time of compressor 2 being substantially zero" also means that input power is slightly changed due to a change in a suction state of compressor 2 caused by deviation of a refrigerant. With respect to the case where a first medium and a second medium are surrounding air, input power to fluid machine 7*a*, 7*b* is slightly changed due to the influence of entrance of wind or the like. That is, "substantially zero" means that a change value is smaller than a predetermined specific value in a state where the above-mentioned change is included.

Under the conditions described above, firstly, a change amount of condensation temperature per unit time is measured by condensation temperature detecting part 10*a*.

Next, a change amount of temperature of the first medium per unit time is detected by first medium temperature detecting part 10*e*, and a change amount of temperature of the second medium per unit time is detected by second medium temperature detecting part 10*f*.

Next, it is determined whether or not the measured change amount of the condensation temperature is larger than either one of a change amount of temperature of the first medium and a change amount of temperature of the second medium.

When it is determined that the measured change amount of the condensation temperature is larger than either one of the change amount of temperature of the first medium and the change amount of temperature of the second medium, it is considered that a disproportionation reaction has occurred in a working fluid and hence, a control is made so as to operate expansion valve 4 in a direction that expansion valve 4 is opened.

In this exemplary embodiment, the example where the increase of pressure along with a disproportionation reaction is controlled only by degree-of-opening control of expansion valve 4 is described. However, the control of a disproportionation reaction is not limited to such a control. When it is difficult to control the pressure by only degree-of-opening control of expansion valve 4, a method substantially equal to the third exemplary embodiment may be performed together with the degree-of-opening control of expansion valve 4. That is, bypass fluid passage 13 may be mounted in parallel to expansion valve 4, and emergency stop of compressor 2 may be carried out. Relief valve 14 or the like may be mounted so as to discharge a refrigerant to the outside thus decreasing a pressure.

In this exemplary embodiment, the example where a degree of opening of expansion valve 4 is controlled with reference to a change amount of temperature detecting part mounted on a two-phase pipe of condenser 3 is described. However, the degree-of-opening control of expansion valve 4 is not limited to such a control. For example, the degree of opening of expansion valve 4 may be controlled with reference to a change amount of pressure detected at some point from a discharge portion of compressor 2 to inlet 4*a* of expansion valve 4. Further, the degree of opening of expansion valve 4 may be controlled with reference to a change amount of degree of supercooling at inlet 4*a* of expansion valve 4.

A degree of opening of expansion valve 4 may be controlled by combining this exemplary embodiment with any one of the above-described first exemplary embodiment to third exemplary embodiment. Due to such an operation, reliability of the refrigeration cycle device can be further improved.

(Fifth Exemplary Embodiment)

Hereinafter, a refrigeration cycle device according to a fifth exemplary embodiment of the present invention is described with reference to FIG. 13.

Figure 13:
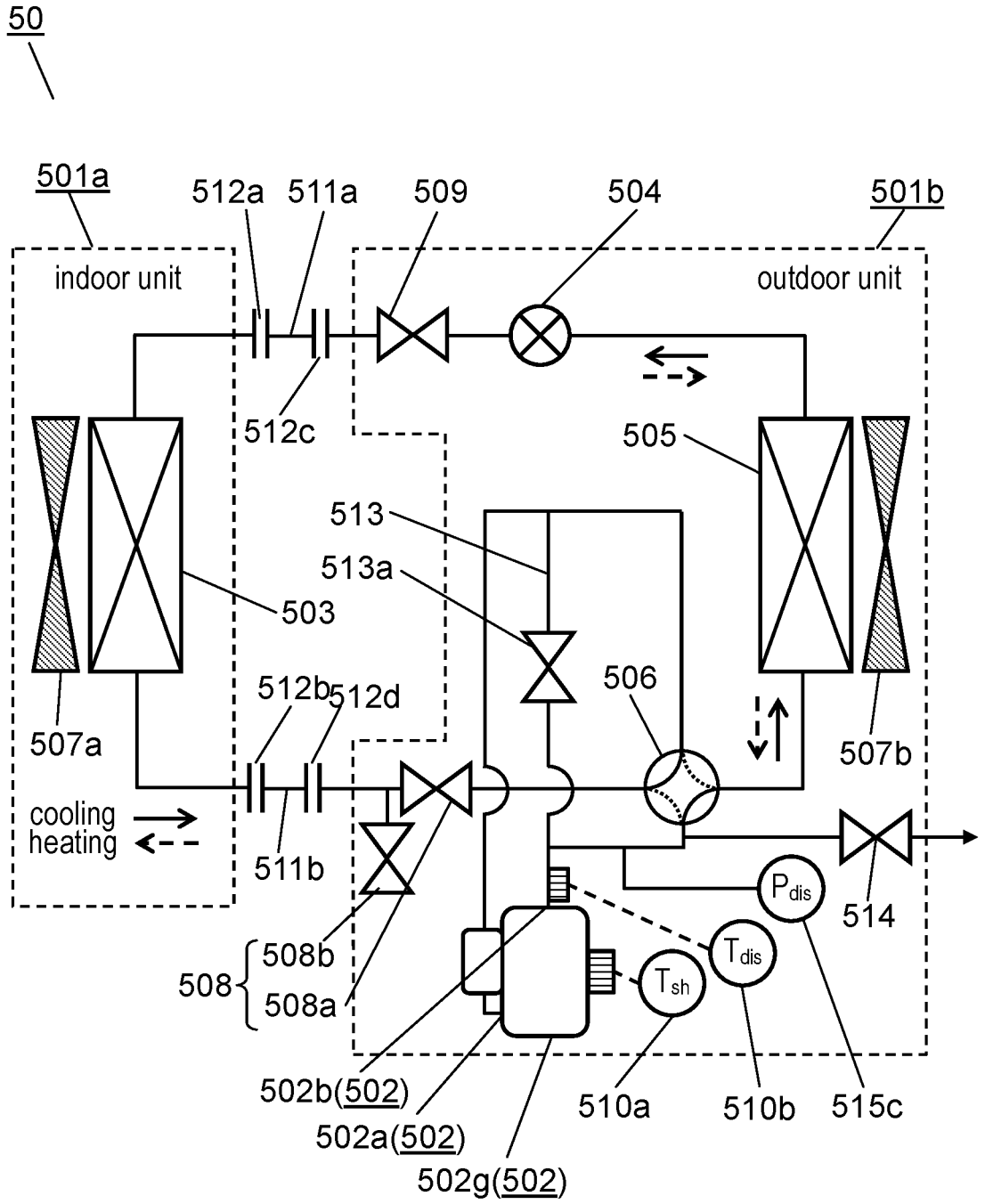
FIG. 13 is a schematic constitutional view of a refrigeration cycle device according to a fifth exemplary embodiment of the present invention.

FIG. 13 is a schematic constitutional view of the refrigeration cycle device according to the fifth exemplary embodiment of the present invention.

As shown in FIG. 13, refrigeration cycle device 50 of this exemplary embodiment is formed of a so-called separate-type air conditioner or the like which includes at least: indoor unit 501*a*; outdoor unit 501*b*; pipe joint portions 512*a*, 512*b*, 512*c*, 512*d* and the like. Indoor unit 501*a* and outdoor unit 501*b* are connected to each other by way of refrigerant pipes, control lines and the like.

Indoor unit 501*a* includes indoor heat exchanger 503, indoor blower fan 507*a* and the like. Indoor blower fan 507*a* is formed of a transverse fan (for example, crossflow fan) which supplies air to indoor heat exchanger 503 and blows out air which is subjected to heat exchange by indoor heat exchanger 503 to the inside of a room.

Outdoor unit 501*b* includes at least: compressor 502; expansion valve 504 which is a pressure reducing portion; outdoor heat exchanger 505; four-way valve 506; outdoor blower fan 507*b* and the like. Outdoor blower fan 507*b* is formed of a propeller fan which supplies air to outdoor heat exchanger 505, for example.

Indoor unit 501*a* includes pipe joint portion 512*a* and pipe joint portion 512*b*. Indoor unit 501*a* includes pipe joint portion 512*a* which separably connects indoor unit 501*a* and outdoor unit 501*b*. Outdoor unit 501*b* includes: pipe joint portion 512*c*; three-way valve 508 disposed between pipe joint portion 512*d* and four-way valve 506; and two-way valve 509 disposed between pipe joint portion 512*c* and expansion valve 504.

Pipe joint portion 512*a* provided at an indoor unit 501*a* side and pipe joint portion 512*c* provided at a two-way valve 509 side of outdoor unit 501*b* are connected to liquid pipe 511*a* which is one of refrigerant pipes. Pipe joint portion 512*b* provided at the indoor unit 501*a* side and pipe joint portion 512*d* provided at a three-way valve 508 side of outdoor unit 501*b* are connected to gas pipe 511*b* which is one of refrigerant pipes.

Shell temperature detecting part 510*a* is mounted on hermetically sealed vessel 502*g* of compressor 502 in outdoor unit 501*b*, and detects a temperature of an outer shell of hermetically sealed vessel 502*g*.

That is, refrigeration cycle device 50 of this exemplary embodiment is formed of at least: compressor 502; indoor heat exchanger 503; expansion valve 504; outdoor heat exchanger 505; the refrigerant pipes and the like. In this case, a refrigeration cycle circuit is formed by sequentially connecting these constitutional elements by the refrigerant pipes.

The refrigeration cycle circuit also includes four-way valve 506 between compressor 502 and indoor heat exchanger 503 or outdoor heat exchanger 505. As four-way valve 506, for example, electromagnetic four-way valve 506 which switches running of refrigeration cycle device 50 between cool running and warm running in response to an electrical signal transmitted from a control circuit (not shown) may be used.

Four-way valve 506 switches the flow direction of a refrigerant discharged from compressor 502 to either one of a direction toward indoor heat exchanger 503 or a direction toward outdoor heat exchanger 505.

That is, running of refrigeration cycle device 50 of this exemplary embodiment is switched between cool running and warm running by four-way valve 506.

More specifically, during cool running, four-way valve 506 is switched so as to make a discharge side of compressor 502 and outdoor heat exchanger 505 communicate with each other, and to make indoor heat exchanger 503 and a suction side of compressor 502 communicate with each other. By switching four-way valve 506 in this manner, indoor heat exchanger 503 functions as an evaporator so that a refrigerant absorbs heat from a surrounding medium (indoor air). At the same time, outdoor heat exchanger 505 functions as a condenser so that heat which the refrigerant absorbs indoors is dissipated to the surrounding medium (outdoor air).

On the other hand, during warm running, four-way valve 506 is switched so as to make the discharge side of compressor 502 and indoor heat exchanger 503 communicate with each other, and to make outdoor heat exchanger 505 and the suction side of compressor 502 communicate with each other. By switching four-way valve 506 in this manner, outdoor heat exchanger 505 functions as an evaporator so that a refrigerant absorbs heat from a surrounding medium (outdoor air). At the same time, indoor heat exchanger 503 functions as a condenser so that heat which the refrigerant absorbs outdoors is dissipated to the surrounding medium (indoor air).

In this exemplary embodiment, air is used as a surrounding medium, for example. Air is driven (supplied) by indoor blower fan 507*a* and outdoor blower fan 507*b* mounted on indoor unit 501*a* and outdoor unit 501*b*, respectively. In this manner, a refrigeration cycle where a heat exchange is performed between a surrounding medium and a refrigerant through indoor heat exchanger 503 and outdoor heat exchanger 505 can be realized.

Refrigeration cycle device 50 according to this exemplary embodiment has the above-mentioned configuration.

Next, functions of above-mentioned three-way valve 508 and two-way valve 509 are specifically described.

Outdoor unit 501*b* includes: three-way valve 508 formed of valve 508*a* and service valve 508*b*; and two-way valve 509. Three-way valve 508 and two-way valve 509 are directed toward indoor unit 501*a*, and are connected to gas pipe 511*b* and liquid pipe 511*a*, respectively.

Three-way valve 508 includes pipe joint portion 512*d* which connects gas pipe 511*b* and three-way valve 508 to each other and a charge port (not shown). On the other hand, two-way valve 509 includes pipe joint portion 512*c* connected to liquid pipe 511*a*. With the use of three-way valve 508 and two-way valve 509, it is possible to provide a structure where indoor unit 501*a* and outdoor unit 501*b* can be separated from each other by fully closing the refrigeration cycle circuit on the outdoor unit 501*b* side.

Pipe joint portion 512*d* of three-way valve 508 and gas pipe 511*b* are connected to each other using a detachable joint (a flare type union or the like, for example) or by brazing, and pipe joint portion 512*c* of two-way valve 509 and liquid pipe 511*a* are also connected to each other in the same manner. Service valve 508*b* is mounted on the charge port of three-way valve 508. This service valve 508*b* enables the evacuation performed at the time of an installation operation or maintenance and the additional filling of a refrigerant.

In general, a household room air conditioner is placed on a market in a so-called pre-charged state where a refrigeration cycle circuit on an outdoor unit 501*b* side is filled with a refrigerant in advance. In this case, the air conditioner is placed on the market in a state where two-way valve 509 and three-way valve 508 are in a fully closed state so as to keep (maintain) the refrigerant in the refrigeration cycle circuit.

Three-way valve 508 and two-way valve 509 function as described above.

Hereinafter, an installation operation of refrigeration cycle device 50 of this exemplary embodiment is briefly described by taking an air conditioner as an example.

Firstly, indoor unit 501*a* and outdoor unit 501*b* are fixed to a place where the air conditioner is installed. Then, indoor unit 501*a* and outdoor unit 501*b* are mechanically connected to each other by way of liquid pipe 511*a* and gas pipe 511*b* and, at the same time, are electrically connected to each other through power source lines and signal lines.

Next, a refrigeration cycle circuit on the indoor unit 501*a* side ranging from two-way valve 509 to three-way valve 508 is evacuated. Thereafter, two-way valve 509 and valve 508*a* of three-way valve 508 are opened thus making the whole refrigeration cycle circuit filled with a refrigerant.

Finally, a test operation of the air conditioner is performed so that the installation operation is completed.

Hereinafter, a removal operation of an air conditioner which is refrigeration cycle device 50 of this exemplary embodiment is briefly described.

In general, when the air conditioner is removed, a so-called pump-down operation is performed where a refrigerant is recovered on the outdoor unit 501*b* side of the refrigeration cycle circuit. Then, after the refrigerant is recovered on the outdoor unit 501*b* side, the respective constitutional elements of refrigeration cycle device 50 are removed.

More specifically, the air conditioner is operated in a cool running mode in a state where two-way valve 509 is closed. With such an operation, a refrigerant is forced to flow to the outdoor unit 501*b* side. Next, after it is confirmed that the refrigerant is not present on the indoor unit 501*a* side, three-way valve 508 is closed and the operation of the air conditioner is stopped.

After the operation of the air conditioner is stopped, pipes and electric lines of indoor unit 501*a* and outdoor unit 501*b* are removed, and, then, indoor unit 501*a* and outdoor unit 501*b* are removed.

The removal operation of the air conditioner is completed through the above-mentioned steps.

Hereinafter, the configuration and the manner of operation of compressor 502 of refrigeration cycle device 50 according to this exemplary embodiment are described with reference to FIG. 14 while also referencing FIG. 13.

Figure 14:
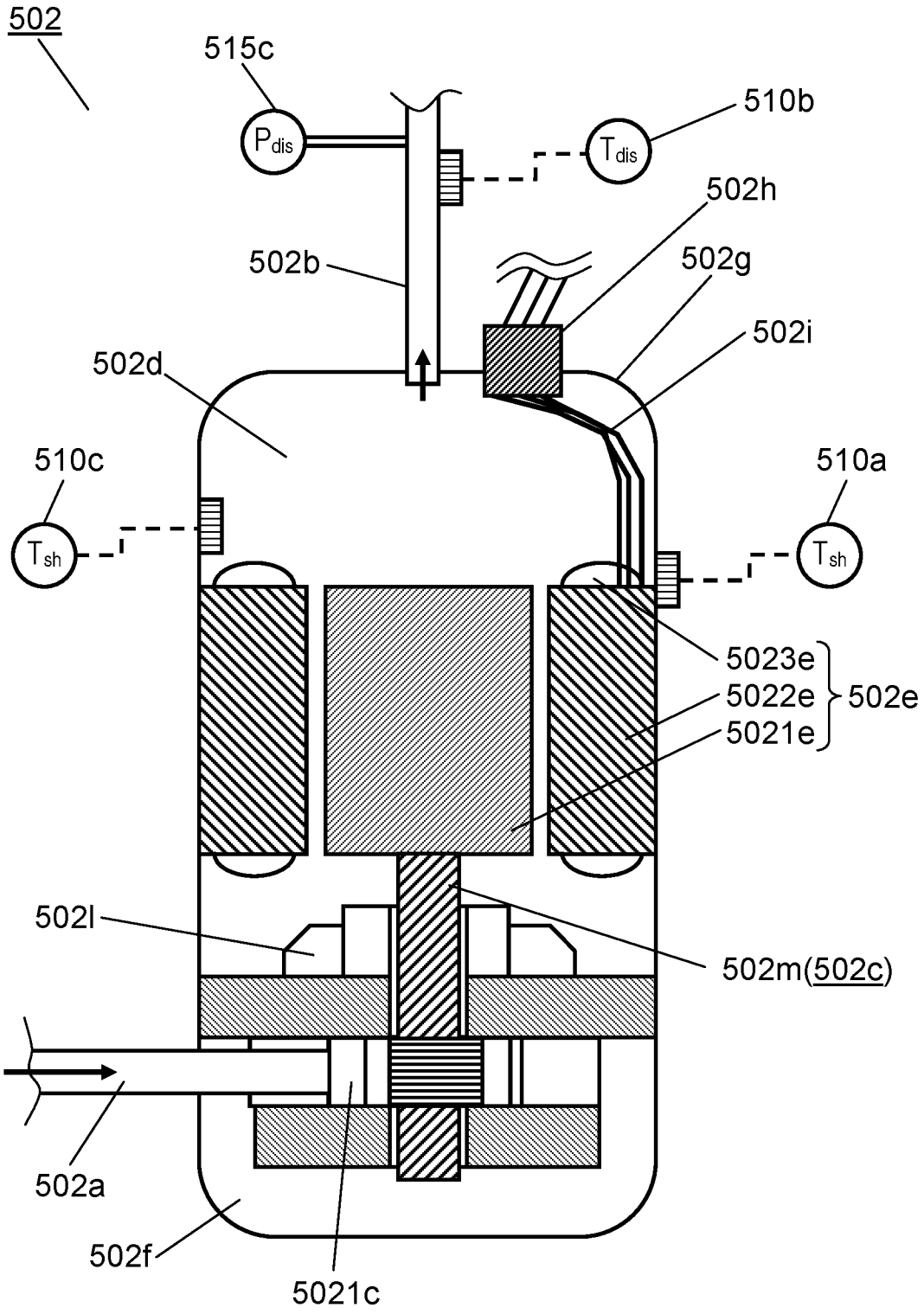
FIG. 14 is a schematic constitutional view of a compressor forming a part of the refrigeration cycle device according to the fifth exemplary embodiment of the present invention.

FIG. 14 is a schematic constitutional view of the compressor which forms a part of the refrigeration cycle device according to the fifth exemplary embodiment of the present invention.

As shown in FIG. 14, compressor 502 of this exemplary embodiment is formed of a so-called sealed rotary type compressor.

Compressor 502 includes hermetically sealed vessel 502*g*, and hermetically sealed vessel 502*g* houses at least electric motor 502*e* formed of a motor, for example, and compressor mechanism 502*c* therein. The inside of hermetically sealed vessel 502*g* is filled with a discharge refrigerant of high pressure and high temperature and refrigerating machine oil.

Electric motor 502*e* includes: rotor 5021*e* connected to compressor mechanism 502*c* by way of crankshaft 502*m*; and stator 5022*e* disposed around rotor 5021*e*.

Next, the manner of operation of compressor 502 is described.

First, a low-pressure refrigerant flown out from the evaporator is sucked into compressor 502 from suction pipe 502*a* through four-way valve 506. A pressure of the sucked low-pressure refrigerant is increased (compressed) by compressor mechanism 502*c*.

The refrigerant whose pressure is increased thus having high temperature and high pressure is discharged from discharge muffler 502*l*. The discharged refrigerant flows into discharge space 502*d* through a gap formed around electric motor 502*e* (a gap between rotor 5021*e* and stator 5022*e* and a gap between stator 5022*e* and hermetically sealed vessel 502*g*).

Then, the refrigerant is discharged to the outside of compressor 502 from discharge pipe 502*b*. The discharged refrigerant circulates in the refrigeration cycle and flows into the condenser through four-way valve 506.

Compressor mechanism 502*c* is connected to electric motor 502*e* by way of crankshaft 502*m*. Electric motor 502*e* converts electricity received from an external power source into mechanical (rotary) energy from electric energy. That is, compressor mechanism 502*c* performs "compression work" for increasing a refrigerant pressure using mechanical energy transmitted from electric motor 502*e* through crankshaft 502*m*.

Compressor 502 is operated as described above.

Next, the description is made with respect to a phenomenon which becomes a cause of occurrence of a disproportionation reaction in the refrigeration cycle device of the exemplary embodiment.

As has been described in the above-mentioned respective exemplary embodiments, a condition where a disproportionation reaction is likely to occur is that a refrigerant is brought into an excessively high temperature and high pressure state. When a high energy source is applied to the refrigerant of high temperature and high pressure atmosphere, this application of the high energy source becomes a trigger for a disproportionation reaction.

That is, to suppress a disproportionation reaction, it is necessary to prevent a refrigerant from being brought into an excessively high temperature and high pressure atmosphere. Alternatively, it is necessary to prevent a high energy source from being applied to a refrigerant in a high temperature and high pressure atmosphere.

In view of the above, in the refrigeration cycle device of this exemplary embodiment, a state where the above-mentioned phenomenon occurs is studied.

Firstly, a state is studied where a refrigerant is brought into an excessively high temperature and high pressure. For example, a situation generated by indoor blower fan 507*a* or outdoor blower fan 507*b* is considered.

In this case, a state is estimated where a blower fan is not sufficiently operated on a condenser side where a refrigerant assumes a high pressure so that the supply of air becomes insufficient whereby heat dissipation from the refrigerant to air which is a surrounding medium does not progress.

More specifically, such a state is a state where the blower fan on the condenser side is abnormally stopped or a state where an air supply path for air driven by the blower fan of the condenser is closed by an obstacle. In such a state, heat dissipation from the refrigerant does not progress and hence, a temperature and a pressure of the refrigerant in the condenser are excessively increased.

On the other hand, any one of the following factors can be considered as a state which is attributed to a refrigerant side.

First, a state is considered where a refrigerant pipe is closed due to a partial breakage of the refrigerant pipe. Alternately, a state is considered where, in performing an installation operation or a maintenance operation, the refrigerant pipe is not sufficiently evacuated and hence, a residue such as moisture or a chip remains or is deposited in a refrigeration cycle circuit including a refrigerant pipe and an expansion valve whereby the refrigeration cycle circuit is closed.

The retention of moisture occurs when moisture existing in air remains in the refrigerant pipe due to lack of evacuation because of water vapor, an operation in rain or the like, for example. The retention of chip or the like occurs when chips generated by cutting pipes at the time of performing a pipe installation operation remain in the pipes, for example. Further, as a state which is attributed to a refrigerant side, considered is a state where an operator forgets to open a two-way valve or a three-way valve in an installation operation so that a refrigeration cycle circuit is closed, or a state where an operator forgets to stop an operation of a refrigeration cycle circuit in performing a pump-down operation.

When a refrigeration cycle circuit is closed during an operation of compressor 502 due to any one of the above-mentioned factors, a pressure of a refrigerant and a temperature of the refrigerant are excessively increased within a range from a discharge portion of compressor 502 to a closing portion of a refrigeration cycle circuit. Accordingly, a state where a disproportionation reaction is likely to occur takes place.

In view of the above, to secure safety in running the refrigeration cycle device, it is necessary to suppress a disproportionation reaction when the above-mentioned state occurs. It is also necessary to take a countermeasure to minimize breaking of the refrigeration cycle device when a disproportionation reaction occurs by chance.

Next, a situation is considered where the refrigeration cycle device is not under a predetermined running condition such as a situation where a high energy source is applied to a refrigerant in a refrigeration cycle circuit.

More specifically, such a situation may be a state where a blower fan on the condenser side is stopped or a refrigeration cycle circuit is closed so that a discharge pressure (a high pressure side of the refrigeration cycle circuit) is excessively increased. Further, such a situation may be a state where biting of a foreign material occurs on a sliding portion of a compressor mechanism which forms a part of a compressor. In this case, electric motor 502*e* exceeds an upper limit value of energy which can be transferred to compressor mechanism 502*c* in the conversion from electricity into mechanical energy. That is, so-called lock abnormality of compressor 502 occurs where compressor mechanism 502*c* cannot perform a compression work for further increasing a refrigerant pressure.

When the supply of electricity to compressor 502 is continued under the above-mentioned state, electricity is excessively supplied to electric motor 502*e* such as a motor which forms a part of compressor 502 so that heat is abnormally generated in electric motor 502*e*. Due to such generation of heat, an insulator for windings which form stator 5022*e* of electric motor 502*e* is broken. As a result, conductor wires of the windings are directly brought into contact with each other thus causing a phenomenon referred to as layer short-circuiting. The layer short-circuiting corresponds to a phenomenon (discharge phenomenon) where high energy is generated under a refrigerant atmosphere in compressor 502. The discharge phenomenon becomes a trigger for causing a disproportionation reaction in a refrigerant formed of the above-mentioned working fluid containing R1123 or the like.

Besides layer short-circuiting, when electricity is excessively supplied to electric motor 502*e*, an insulator for lead line 502*i* and electricity supply terminal 502*h* for supplying electricity to electric motor 502*e* are broken. Accordingly, there is a possibility that the short-circuiting occurs. For this reason, the short-circuiting which occurs at such portions also becomes a trigger for the disproportionation reaction.

In view of the above, in this exemplary embodiment, a control is made so as to prevent electricity (electric power) of an excessive amount which becomes a trigger for the above-mentioned disproportionation reaction from being applied to compressor 502.

Hereinafter, a control of the refrigeration cycle device according to this exemplary embodiment is described with reference to FIG. 15.

Figure 15:
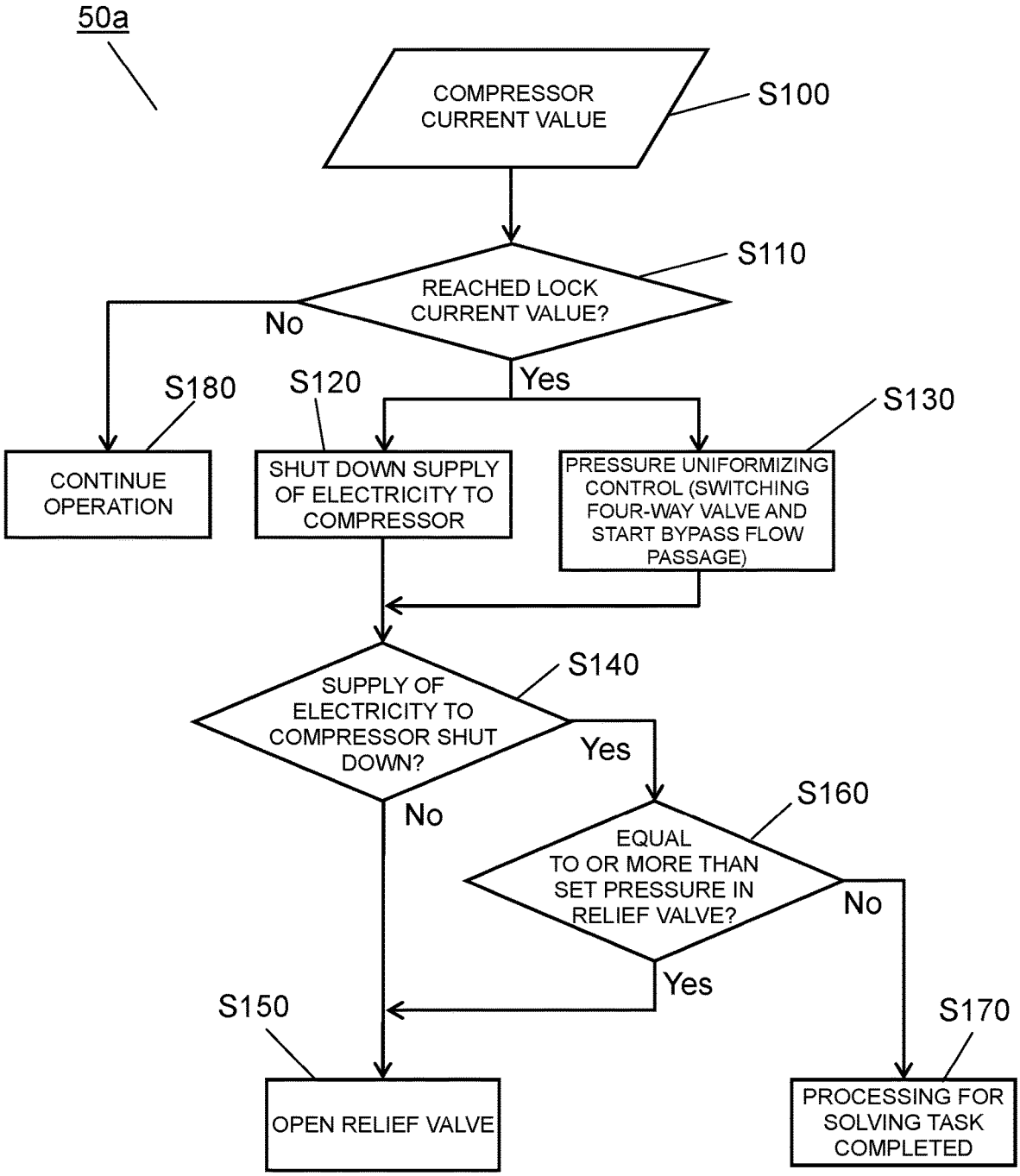
FIG. 15 is a flowchart for describing a control of the refrigeration cycle device according to the fifth exemplary embodiment of the present invention.

FIG. 15 is a flowchart for describing the control of the refrigeration cycle device according to the fifth exemplary embodiment of the present invention.

FIG. 15 shows flowchart 50*a* of a control to suppress a disproportionation reaction using a current value of an electric current supplied to compressor 502.

More specifically, the case is considered where electric motor 502*e* to which electricity is supplied exceeds a maximum torque so that electric motor 502*e* is stopped. In this case, when a current value at a breakdown torque (lock current value) continues for a predetermined time, the possibility is increased that a layer short-circuiting which becomes a source of the occurrence of a disproportionation reaction occurs. Accordingly, various countermeasures are taken in accordance with the following controls. The above-mentioned predetermined time is set corresponding to a kind of electric motor 502*e*, durability of an insulator of electric motor 502*e*, a heat dissipation property of electric motor 502*e* to a surrounding medium or the like. Hereinafter, description is made assuming that the predetermined time is set to 15 seconds, for example.

As shown in FIG. 15, firstly, a current value of an electric current supplied to compressor 502 is detected (step S100).

Next, it is determined whether or not the current value reaches a lock current value (step S110). When the current value has not yet reached the lock current value (No in step S110), an operation of compressor 502 is continued (step S180).

On the other hand, when the current value has reached the lock current value and the lock current value continues for 15 seconds or more (Yes in step S110), a control is performed so as to shut down the supply of electricity to compressor 502 (step S120). At this stage of operation, a value of supply power (electric current) is recorded in a control circuit. Accordingly, when the lock current is detected continuously for 15 seconds, the control device sends an instruction to shut down power supply to compressor 502 to a power source circuit.

Besides the above-mentioned method of shutting down the supply power, it may be possible to use a method which adopts, for example, an OLP (Over Load Protector) which shuts down the circuit when an electric current of a predetermined value or more flows to compressor 502. In this case, from a viewpoint of safety, it is preferable to adopt the configuration which is not automatically restored such as a breaker or a fuse, for example.

It is also possible to adopt the configuration where electricity supply terminal 502*h* for supplying electricity to electric motor 502*e* which is disposed outside hermetically sealed vessel 502*g* is disconnected earlier than short-circuiting between wirings of stator 5022*e* of electric motor 502*e* or short-circuiting between lead lines 502*i*. More specifically, a contact portion of electricity supply terminal 502*h* is cut by welding. The configuration may be adopted where when a lock current (overcurrent) flows for a fixed time or more, the contact portion of electricity supply terminal 502*h* is cut by welding.

The detection of lock abnormality of electric motor 502*e* may be performed by, besides the detection of a lock current value, detecting rotational behavior of rotor 5021*e* of electric motor 502*e* using a potentiometer or the like, for example. In this case, when the potentiometer detects a stop of rotation of rotor 5021*e* during an operation, it is determined that electric motor 502*e* is in a lock abnormal state and a control is performed based on such determination.

When necessary, along with the shutdown of the supply of electricity to compressor 502 in step S120, a control of switching four-way valve 506 in a pressure uniformizing direction may be added (step S130). More specifically, when warm running is performed, such warm running is switched to cool running, while when cool running is performed, such cool running is switched to warm running. In FIG. 15, the flow where both of step S120 and step S130 are performed is described. However, it is not always necessary to perform step S130.

For example, in case of warm running, the condenser where a refrigerant becomes a high pressure is indoor heat exchanger 503 on an indoor unit 501*a* side. Accordingly, when indoor blower fan 507*a* is stopped, a refrigerant pressure in a range from discharge pipe 502*b* or discharge space 502*d* of compressor 502 to indoor heat exchanger 503 becomes an excessively high pressure. Lock abnormality of compressor 502 is a state which never fails to occur when a refrigerant pressure on a discharge side becomes excessively high so that compression mechanism 502*c* cannot perform a compression work.

In view of the above, when lock abnormality of compressor 502 occurs, it is determined that a refrigerant pressure on a discharge side becomes an excessively high pressure. Then, a control of switching four-way valve 506 from warm running to cool running (step S130) is performed in combination with the shutdown of the supply of electricity to compressor 502 (step S120). By performing such steps, the occurrence of a disproportionation reaction can be prevented.

As the cause of the occurrence of lock abnormality, various other causes are considered although these causes are not specifically described. However, eventually, when lock abnormality occurs, abnormal heat generation by compressor 502 is induced thus giving rise to a possibility that short-circuiting which becomes a trigger for generating a disproportionation reaction occurs. Accordingly, it is more preferable to perform the operation in step S130 for lowering a pressure of a refrigerant when lock abnormality occurs from a viewpoint of suppressing occurrence of a disproportionation reaction. Further, it is more preferable to perform the operation in step S130 and the operation in step S120 in combination from a viewpoint of securing safety in a multiple manner.

That is, in step S130, four-way valve 506 is switched from warm running to cool running. With such an operation, a refrigerant of a high pressure is introduced to a suction side of compressor 502 and an outdoor unit 501*b* side which are at a low pressure before switching four-way valve 506. As a result, a pressure of a refrigerant on an indoor unit 501*a* side is rapidly lowered so that a refrigerant in the refrigeration cycle circuit can be changed into a uniform pressure state.

More specifically, switching of four-way valve 506 is instructed along with the shutdown of the supply of electricity to compressor 502 by the control circuit. Accordingly, when the shutdown of the supply of electricity to compressor 502 is performed using an OLP, a breaker or the like, the control circuit of refrigeration cycle device 50 instructs switching of four-way valve 506 when the shutdown of the supply of electricity to compressor 502 is detected.

Although the switching operation of the four-way valve has been described by taking warm running as an example heretofore, in case of cool running, four-way valve 506 may be switched from cool running to warm running opposite to the above-mentioned case.

Further, as shown in FIG. 13, refrigeration cycle device 50 may further include bypass flow passage 513 which makes suction pipe 502*a* and discharge pipe 502*b* of compressor 502 communicate with each other and has bypass open/close valve 513*a*, and a control in step S130 may be performed. That is, in step S130, along with switching of four-way valve 506, bypass open/close valve 513*a* of bypass flow passage 513 may be controlled in an opening direction. With such an operation, a refrigerant in the refrigeration cycle circuit can be brought into a uniform pressure state further rapidly.

There is no problem in performing only either one of switching of four-way valve 506 and controlling of bypass flow passage 513. However, it is preferable to perform a control where both of a switching control of four-way valve 506 and a pressure uniformizing control by bypass flow passage 513. In this case, even when either one of four-way valve 506 or bypass flow passage 513 is not operated, it is possible to perform a pressure uniformizing control using the other. That is, such a control is preferable from a viewpoint of a control which takes into account fail safe.

As shown in FIG. 13, a control may be performed so as to discharge a refrigerant to an external space using relief valve 514 which is disposed in discharge pipe 502*b* or discharge space 502*d* of compressor 502 and forms an atmosphere open portion. Relief valve 514 may be disposed within a range from a discharge portion of compressor 502 to expansion valve 4 or within a range from the discharge portion of compressor 502 to three-way valve 508. However, it is more desirable to dispose relief valve 514 within a range from the discharge portion of compressor 502 to four-way valve 506. With such a configuration, a pressure in compressor 502 can be rapidly released to the outside.

Next, the description is made with respect to processing performed when the supply of electricity to compressor 502 cannot be shut down due to the following reasons in step S120.

That is, in step S120, when the supply of electricity to compressor 502 is not shut down due to welding of a terminal of a power source part or the like, the supply of electricity to compressor 502 is continued. In this case, it is difficult to prevent the occurrence of short-circuiting in electric motor 502*e* due to supplied electricity. In this case, as described with reference to step S130, a control is performed so as to reduce a pressure on a discharge side in the refrigeration cycle circuit by switching four-way valve 506 or by way of bypass flow passage 513. However, even when a pressure of a refrigerant is changed into a uniform pressure state in step S130, it is difficult to suppress the occurrence of a disproportionation reaction with certainty.

In view of the above, as shown in FIG. 15, it is determined whether or not the supply of electricity to compressor 502 is shut down (step S140). When it is determined that the supply of electricity to compressor 502 is not shut down (No in step S140), relief valve 514 is opened (step S150). Then, a refrigerant is discharged to an external space by way of relief valve 514. Accordingly, a control is performed so as to prevent breaking of a body of refrigeration cycle device 50 thus preventing spreading of damage caused by scattering of parts of refrigeration cycle device 50 to the surrounding.

On the other hand, the supply of electricity to compressor 502 is shut down (Yes in step S140), it is determined whether or not an increased pressure is equal to or more than a set pressure of relief valve 514 (step S160). When the increased pressure is equal to or more than the set pressure of relief valve 514 (Yes is step S160), relief valve 514 is opened (step S150).

On the other hand, when the increased pressure is less than the set pressure in relief valve 514 (No in step S160), processing taken to cope with the case where the supply of electricity to compressor 502 cannot be shut down is completed (step S170).

Then, the above-mentioned processing is performed for a predetermined time or is performed constantly and repeatedly so as to control the refrigeration cycle device.

In this exemplary embodiment, an open portion of relief valve 514 is disposed outdoors in the same manner as relief valve 14 in the third exemplary embodiment. It is preferable to dispose relief valve 514 at a position within a range from discharge space 502*d* to discharge pipe 502*b* of the body of compressor 502 where a state of a refrigerant becomes a highest temperature and a highest pressure. It is further preferable to dispose relief valve 514 in the body of compressor 502. With such a configuration, a high-temperature and high-pressure state of a refrigerant can be alleviated.

Relief valve 514 may be an electronically controlled open/close valve, a spring-type relief valve or a rupture disk.

More specifically, as shown in FIG. 15, when a control is performed with a value of electricity (electric current) supplied to compressor 502, a control of opening relief valve 514 is performed when the supply of electricity is continued even when the control circuit issues an instruction of shutting down the supply of electricity to compressor 502.

In such a control, in case of spring-type relief valve 514, a set value of a blowout pressure at which a refrigerant continuously blows out is set to a value which is 1.2 times or less as large as an allowable pressure of a refrigerant in the refrigeration cycle device at a portion where relief valve 514 is disposed or a value which is 1.15 times or less as large as a blow start pressure.

When relief valve 514 is a rupture disk, breaking pressure is set to a set pressure value which falls within a range of approximately 0.8 to 1.0 times as large as a pressure resistance test pressure of the refrigeration cycle device at a portion where the rupture disk is disposed.

It is not always necessary to use only one relief valve 514, and a plurality of relief valves 514 may be used. In this case, a refrigerant can be rapidly released to an atmosphere and hence, the use of a plurality of relief valves 514 is preferable from a viewpoint of avoiding breaking of the body of refrigeration cycle device 1 as much as possible.

It is preferable to perform the above-mentioned control by using both of supply electricity and a pressure value as parameters for controlling relief valve 514 from a viewpoint of ensuring safety in a multiple manner.

<Modification 1>

Heretofore, the description has been made with respect to the control method for suppressing occurrence of a disproportionation reaction using a current value of an electric current supplied to compressor 502 as an example. However, the present invention is not limited to such a control method. For example, a control for suppressing occurrence of a disproportionation reaction may be performed by grasping a phenomenon which becomes a trigger of occurrence of a disproportionation reaction based on temperature difference between discharge pipe temperature Tdis and shell temperature Tsh (temperature of hermetically sealed vessel 502*g* which forms a part of the compressor).

Hereinafter, modification 1 of a control for suppressing occurrence of a disproportionation reaction according to this exemplary embodiment is described with reference to FIG. 16 while also referencing FIG. 13 and FIG. 14.

Figure 16:
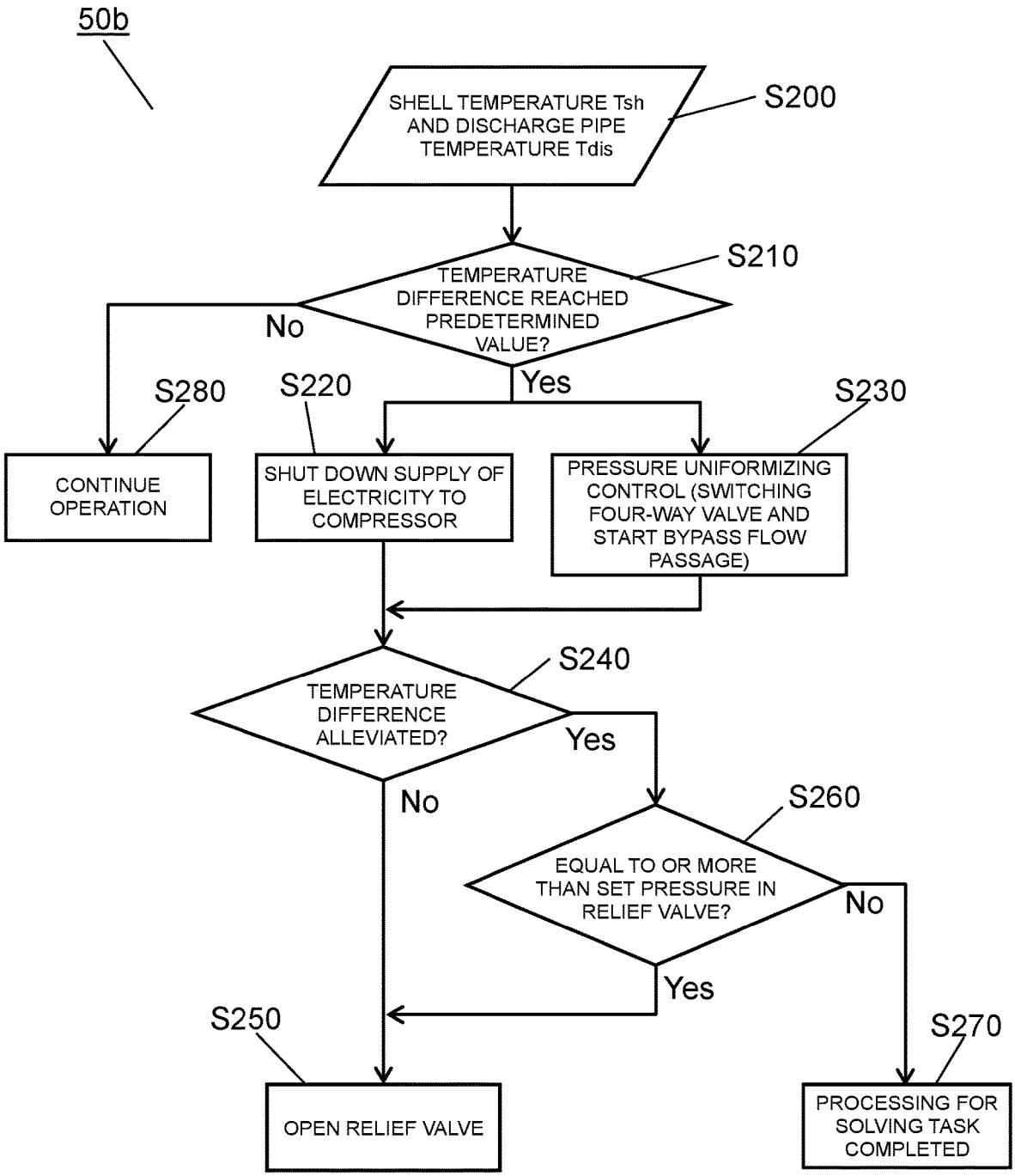
FIG. 16 is a flowchart for describing a control of modification 1 of the refrigeration cycle device according to the fifth exemplary embodiment of the present invention.

FIG. 16 is a flowchart for describing a control of modification 1 of the refrigeration cycle device according to the fifth exemplary embodiment of the present invention.

FIG. 16 shows flowchart 50*b* of a control for suppressing occurrence of a disproportionation reaction based on temperature difference between discharge pipe temperature Tdis and shell temperature Tsh.

Discharge pipe temperature Tdis and shell temperature Tsh are measured by discharge pipe temperature detecting part 510*b* disposed on discharge pipe 502*b* of compressor 502 and shell temperature detecting part 510*a* disposed outside hermetically sealed vessel 502*g* of compressor 502 both of which are shown in FIG. 13. In this case, as shown in FIG. 14, it is desirable to dispose shell temperature detecting part 510*a* near stator 5022*e* of electric motor 502*e*. It is more preferable to dispose shell temperature detecting part 510*a* near coil end portion 5023*e* of electric motor 502*e*. With such a configuration, a temperature of stator 5022*e* of electric motor 502*e* disposed in the inside of compressor 502 can be detected with high sensitivity.

In modification 1, discharge pipe temperature detecting part 510*b* is formed of a thermistor, a thermocouple or the like, for example, and electrically detects a temperature. A detection value is electrically transmitted to the control circuit.

Firstly, the description is made with respect to behaviors of discharge pipe temperature Tdis of compressor 502 and shell temperature Tsh which are control parameters used in modification 1. For example, in case where compressor 502 is a compressor of a high pressure shell type, surrounding of electric motor 502*e* is filled with a discharge refrigerant of a high pressure.

When an operation of compressor 502 is normal, although electric motor 502*e* is slightly heated, generated heat is sucked by the surrounding refrigerant. The refrigerant which receives heat from electric motor 502*e* is discharged from discharge pipe 502*b* of compressor 502, and advances toward the condenser. At this stage of operation, the refrigerant constantly flows toward the outside from discharge space 502*d* of compressor 502. Accordingly, heat is transferred to the outside of compressor 502 by the refrigerant and hence, a phenomenon that a temperature of electric motor 502*e* is continuously increased does not occur. As a result, there is no possibility that sell temperature Tsh of compressor 502 is excessively increased (abnormal heat generation) so that shell temperature Tsh does not largely differ from a discharge temperature of the refrigerant.

On the other hand, when the refrigeration cycle does not function normally and lock abnormality occurs in compressor 502, as described previously, compressor 502 cannot perform a compression work. At this stage of operation, electricity (electric energy) supplied to electric motor 502*e* cannot be converted into mechanical energy and is converted into heat energy. Accordingly, a temperature of electric motor 502*e* is excessively increased (abnormal heat generation). At this stage of operation, the refrigerant does not flow and hence, the heat dissipation from electric motor 502*e* also does not progress. Accordingly, the temperature of electric motor 502*e* and the temperature of the refrigerant near electric motor 502*e* are continuously increased. As a result, shell temperature Tsh of compressor 502 which embraces electric motor 502*e* is also increased.

On the other hand, discharge pipe temperature Tdis of compressor 502 exhibits a small temperature increase rate compared to a temperature increase rate of the refrigerant around electric motor 502*e*. This is because discharge pipe 502*b* is disposed away from electric motor 502*e* which is a heat source, and a discharge refrigerant toward discharge pipe 502*b* does not flow.

That is, when lock abnormality occurs in compressor 502, the difference between shell temperature Tsh and discharge pipe temperature Tdis is gradually increased.

In view of the above, in this modification, abnormality of electric motor 502*e* of compressor 502 is detected by measuring a behavior (change) of the temperature difference between shell temperature Tsh and discharge pipe temperature Tdis. Then, a control is performed so as to stop the supply of electricity to compressor 502 based on the temperature difference.

Firstly, the behavior of temperature difference between shell temperature Tsh and discharge pipe temperature Tdis is specifically described with reference to FIG. 17.

Figure 17:
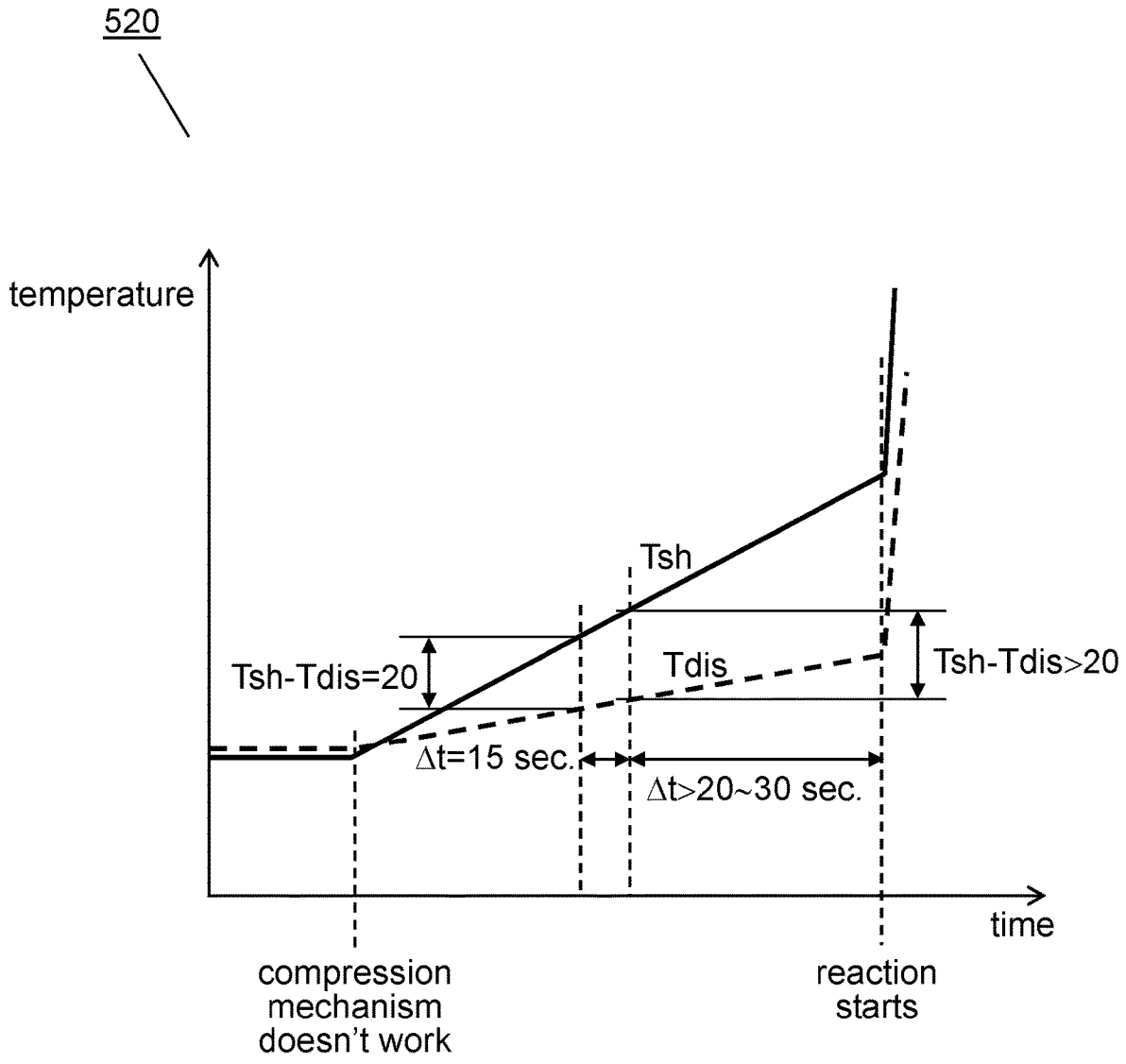
FIG. 17 is a schematic operational view of a temperature detecting part according to modification 1 of the refrigeration cycle device according to the fifth exemplary embodiment of the present invention.

FIG. 17 is a schematic operational view of a temperature detecting part according to modification 1 of the refrigeration cycle device according to the fifth exemplary embodiment of the present invention.

FIG. 17 shows temperature histories 520 of shell temperature Tsh detected by shell temperature detecting part 510*a* and discharge temperature Tdis detected by discharge pipe temperature detecting part 510*b*.

As shown in FIG. 17, after lock abnormality occurs in compressor 502, the temperature difference between shell temperature Tsh and discharge temperature Tdis is increased with time.

Then, when a state where the temperature difference exceeds a predetermined value (for example, $\Delta T=20K$) for a predetermined time (for example, $\Delta t=15$ seconds), the supply of electricity to compressor 502 is interrupted. The above-mentioned predetermined values of temperature difference and time are decided based on a mixing ratio of a refrigerant, discharge space 502*d* of compressor 502, capacity of compressor 502 and positions where the respective temperature detecting parts are disposed. Accordingly, usually, the predetermined values of temperature difference and time are acquired experimentally and set.

It is preferable to set the predetermined value of time difference such that the supply of electricity is shut down 20 to 30 seconds before short-circuiting occurs between wirings, between lead lines 502*i* or at electricity supply terminal 502*h* in electric motor 502*e* which forms a part of compressor 502 becoming a trigger of a disproportionation reaction. This is because when the supply of electricity is shut down several seconds before short-circuiting occurs, tolerance in time is small and hence, 20 to 30 seconds are set to ensure tolerance in safety.

Hereinafter, a control according to modification 1 is specifically described with reference to FIG. 16.

As shown in FIG. 16, firstly, shell temperature Tsh and discharge pipe temperature Tdis are detected (step S200). At this stage of operation, after detection values of shell temperature Tsh and discharge temperature Tdis are detected by the respective temperature detecting parts, the detection values are recorded in the control circuit.

Next, the control circuit determines whether or not a state that the temperature difference between shell temperature Tsh and discharge temperature Tdis is increased exceeding a predetermined value is continued for a predetermined time (step S210). When the temperature difference has not yet reached the predetermined value (for example, ΔT=20K) (No in step S210), an operation of compressor 502 is continued (step S280).

On the other hand, when the temperature difference has reached the predetermined value and this state has continued for 15 seconds or more (Yes in step S210), the control circuit performs a control of the shutdown of the supply of electricity to compressor 502 (step S220). At this stage of operation, the control circuit transmits a signal which instructs the shutdown of the supply of electricity to compressor 502 to the power source circuit. Accordingly, a switch for supplying electricity to compressor 502 is opened so that the supply of electricity is shut down. Step S220 is substantially equal to step S120 in flowchart 50*a* used in the first exemplary embodiment and hence, the detailed description of step S220 is omitted.

In this case, it is desirable to adopt the configuration where the shutdown of the supply of electricity to compressor 502 is not automatically restored from a viewpoint of ensuring safety. That is, it is preferable to adopt the configuration where a restoring switch is disposed in a power source circuit, for example, and the supply of electricity is not restored unless the restoring switch is turned on.

By performing the above-mentioned processing flow, the supply of electricity to compressor 502 can be shut down before short-circuiting of electric motor 502*e* which becomes a trigger of a disproportionation reaction starts.

In the same manner as step S130 in flowchart 50*a* of the above-mentioned exemplary embodiment, also in modification 1, as shown in step S230, a control of four-way valve 506, bypass open/close valve 513*a* of bypass flow passage 513 and relief valve 514 may be performed using the temperature difference between discharge pipe temperature Tdis and shell temperature Tsh. In this case, set values used in the control of four-way valve 506 and bypass open/close valve 513*a* may be set in the same manner as the set values used for shutting down the supply of electricity described in the above-mentioned exemplary embodiment. Step S230 is substantially equal to step S130 in the exemplary embodiment and hence, the detailed description of step S230 is omitted.

In step S230 in modification 1, even when a pressure of a refrigerant is changed to a uniform pressure state, it is difficult to suppress the occurrence of a disproportionation reaction with certainty. Further, there may be also a case where the supply of electricity to compressor 502 is not shut down.

In view of the above, in modification 1, as shown in FIG. 16, it is determined whether or not the temperature difference between discharge pipe temperature Tdis and shell temperature Tsh is alleviated (decreased) (step S240). When the temperature difference is not alleviated (No in step S240), relief valve 514 is opened (step S250). This is because it is estimated that when the temperature difference between discharge pipe temperature Tdis and shell temperature Tsh is continuously increased even when a control of the shutdown of the supply of electricity to compressor 502 and a control of four-way valve 506 and bypass open/close valve 513*a* of bypass flow passage 513 are performed, the supply of electricity to compressor 502 is not shut down or a disproportionation reaction occurs. Accordingly, a control is performed so as to release a working fluid to the outside by opening relief valve 514.

On the other hand, when the temperature difference is alleviated (Yes in step S240), it is determined whether or not an increased pressure is equal to or above a set pressure of relief valve 514 (step S260). When the increased pressure is equal to or above the set pressure of relief valve 514 (Yes in step S260), relief valve 514 is opened (step S250).

On the other hand, when the increased pressure is less than the set pressure of relief valve 514 (No in step S260), processing taken to cope with the case where the temperature difference is not alleviated is completed (step S270).

Then, the above-mentioned processing is performed for a predetermined time or is performed constantly and repeatedly so as to control the refrigeration cycle device.

In this case, a valve open control may be performed based on a pressure using the above-mentioned spring type relief valve 514 or rupture disk. With such a configuration, safety can be ensured in a multiple manner.

In the control performed in modification 1, a control for detecting electricity (current value) supplied to compressor 502 in the above-mentioned fifth exemplary embodiment may be performed in combination. With such controls, when either one of these controls detects abnormality, the above-mentioned control can be performed. As a result, safety can be ensured in a multiple manner and hence, such a configuration is more preferable.

<Modification 2>

In modification 2, a control is performed by grasping a phenomenon which becomes a trigger of the occurrence of a disproportionation reaction based on only shell temperature Tsh detected by shell temperature detecting part 510*a*. Modification 2 is described hereinafter.

In modification 2, firstly, a temperature of stator 5022*e* of electric motor 502*e* before stator 5022*e* which forms a part of electric motor 502*e* of compressor 502 generates short-circuiting is measured. Then, a phenomenon which becomes a trigger of the occurrence of a disproportionation reaction is grasped based on the measured temperature. Modification 2 provides a control of suppressing occurrence of a disproportionation reaction based on such a phenomenon.

In this case, in modification 2, shell temperature detecting part 510*a* is used as a stator temperature detecting part which detects a temperature of stator 5022*e* of electric motor 502*e*. A control is performed such that a temperature of stator 5022*e* is indirectly detected by shell temperature detecting part 510*a*, and a control is performed by detecting a disproportionation reaction.

Hereinafter, modification 2 of a control for suppressing occurrence of a disproportionation reaction according to this exemplary embodiment is described with reference to FIG. 18.

Figure 18:
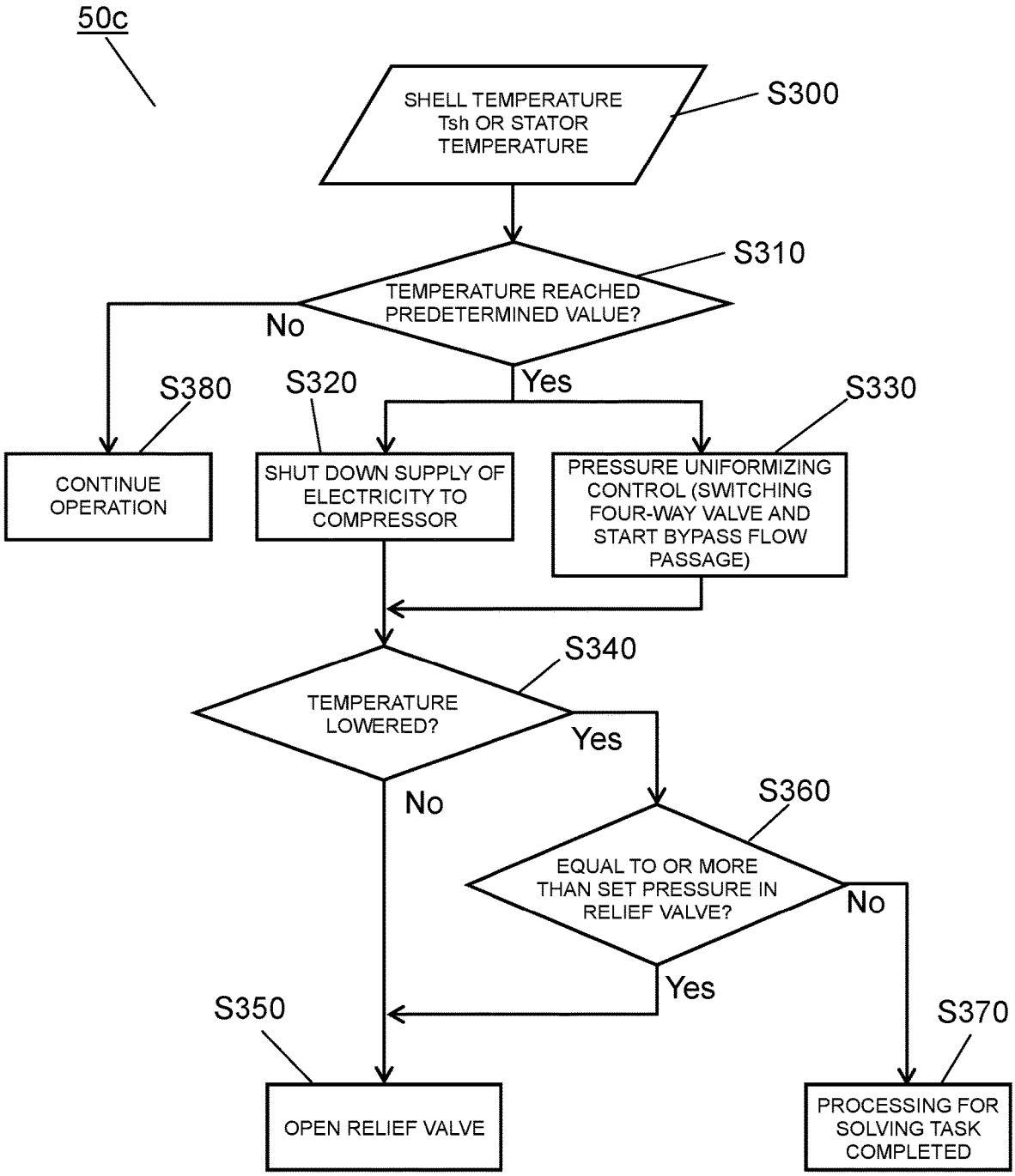
FIG. 18 is a flowchart for describing controls of modification 2 and modification 3 of the refrigeration cycle device according to the fifth exemplary embodiment of the present invention.

FIG. 18 is a flowchart for describing a control of modification 2 of the refrigeration cycle device according to the fifth exemplary embodiment of the present invention.

That is, FIG. 18 shows flowchart 50*c* of a control for suppressing occurrence of a disproportionation reaction using shell temperature Tsh.

A set temperature of stator 5022*e* for shutting down the supply of electricity to compressor 502 is set by taking into account tolerance in safety from the lowest temperature among temperatures described below. That is, the set temperature of stator 5022*e* is set from temperatures at which windings of stator 5022*e*, lead lines 502*i* for supplying electricity to stator 5022*e* and an insulator which embraces electricity supply terminal 502*h* break.

Hereinafter, the idea of setting the above-mentioned temperatures is described.

Firstly, assume a temperature of stator 5022*e* generated by short-circuiting of windings of electric motor 502*e*, short-circuiting between lead lines 502*i* of electric motor 502*e* or short-circuiting of electricity supply terminal 502*h* as 200° C., for example.

In this case, shell temperature Tsh of a shell of hermetically sealed vessel 502*g* facing a side of air which is a surrounding medium becomes lower than a temperature of stator 5022*e* on a high heat source side when short-circuiting occurs (for example, lower than 200° C.).

When such short-circuiting occurs, a place where short-circuiting occurs between stators 5022*e* becomes a trigger of the occurrence of a disproportionation reaction. That is, it is necessary to perform a control by taking into account tolerance in safety such that a temperature of stator 5022*e* which is short-circuited due to breakage of an insulator is not increased to 200° C.

In view of the above, in modification 2, a control is performed by setting a set temperature of shell temperature Tsh to approximately 150° C., for example.

Shell temperature detecting part 510*a* may be formed of a thermistor, a thermocouple or the like, for example, which electrically detects a temperature. Shell temperature detecting part 510*a* may be also formed of a bimetal, for example, which mechanically detects a temperature. Shell temperature detecting part 510*a* may be a non-contact-type temperature detecting part such as a thermography, for example.

Hereinafter, a control according to modification 2 is specifically described with reference to FIG. 18.

As shown in FIG. 18, firstly, shell temperature Tsh is detected by shell temperature detecting part 510*a* (step S300). At this stage of operation, after the detection by shell temperature detecting part 510*a*, a detection value of shell temperature Tsh is recorded in the control circuit.

Next, the control circuit determines whether or not shell temperature Tsh has reached a predetermined value (150° C.) (step S310). When shell temperature Tsh has not yet reached the predetermined value (No in step S310), an operation of compressor 502 is continued (step S380).

On the other hand, when shell temperature Tsh has reached the predetermined value (Yes in step S310), the control circuit performs a control for shutting down the supply of electricity to compressor 502 (step S320). In such a control, when a thermistor or a thermocouple is used as shell temperature detecting part 510*a*, a detection value of shell temperature Tsh is transmitted to the control circuit as an electric signal. Then, the control circuit outputs an instruction of shutting down the supply of electricity to a power source circuit which supplies electricity to compressor 502 when shell temperature Tsh reaches a predetermined value (for example, 150° C.). Accordingly, a switch for supplying electricity to compressor 502 is opened so that the supply of electricity is shut down. On the other hand, when a bimetal is used as shell temperature detecting part 510*a*, for example, the supply of electricity to compressor 502 is shut down using a thermal relay which is shut down at a predetermined temperature (for example, 150° C.) for example.

Step S320 is substantially equal to step S120 and step S220 in flowcharts 50*a*, 50*b* used in the exemplary embodiment and modification 1 and hence, the detailed description of step S320 is omitted.

In the above-mentioned modification, a control of shutting down the supply of electricity to compressor 502 may be performed in combination with the method of electrically detecting a temperature and the method of mechanically detecting a temperature. With such a control, safety can be ensured in a multiple manner.

By performing the above-mentioned processing flow, the supply of electricity to compressor 502 can be shut down before shell temperature Tsh which becomes a trigger for a disproportionation reaction exceeds a predetermined temperature.

In the same manner as step S130 in flowchart 50*a* of the above-mentioned exemplary embodiment, also in modification 2, as shown in step S330, a control of four-way valve 506, bypass open/close valve 513*a* of bypass flow passage 513 and relief valve 514 may be performed using a detection value of shell temperature Tsh detected by shell temperature detecting part 510*a*. In this case, set values used in the control of four-way valve 506 and bypass flow passage 513 may be set in the same manner as the set values used for shutting down the supply of electricity in the above-mentioned exemplary embodiment. Step S330 is substantially equal to step S130 in the exemplary embodiment and hence, the detailed description of step S330 is omitted.

In step S330 in modification 2, even when a pressure of a refrigerant is changed to a uniform pressure state, it is difficult to suppress the occurrence of a disproportionation reaction with certainty. Further, there may be also a case where the supply of electricity to compressor 502 is not shut down.

In view of the above, in modification 2, as shown in FIG. 18, it is determined whether or not shell temperature Tsh measured by shell temperature detecting part 510*a* is lowered (step S340). When shell temperature Tsh is not lowered (No in step S340), relief valve 514 is opened (step S350). This is because it is estimated that when the temperature increase measured by shell temperature detecting part 510*a* is not stopped even when a control of the shutdown of the supply of electricity to compressor 502 and a control of four-way valve 506 and bypass open/close valve 513*a* of bypass flow passage 513 are performed, the supply of electricity to the compressor is not shut down or a disproportionation reaction occurs. Accordingly, a control is performed so as to release a working fluid to the outside by opening relief valve 514.

In such operations, when a temperature is electrically detected, for example, a control of relief valve 514 may be performed electrically in the same manner. When a temperature is mechanically detected, a control may be performed by turning on a switch which opens relief valve 514 at a set temperature or above using a thermal relay.

On the other hand, when shell temperature Tsh is lowered (Yes in step S340), it is determined whether or not an increased pressure is equal to or above a set pressure of relief valve 514 (step S360). When the increased pressure is equal to or above the set pressure of relief valve 514 (Yes in step S360), relief valve 514 is opened (step S350).

On the other hand, when the increased pressure is less than the set pressure of relief valve 514 (No in step S360), processing taken to cope with the case where shell temperature Tsh is not lowered is completed (step S370).

In this case, a valve open control may be performed based on a pressure using above-mentioned spring type relief valve 514 or rupture disk. With such a configuration, safety can be ensured in a multiple manner.

In the control performed in modification 2, a control for lowering shell temperature Tsh may be performed in combination with a control for detecting electricity supplied to compressor 502 in the above-mentioned fifth exemplary embodiment and a control for detecting of temperature difference in modification 1. With such a configuration, when abnormality is detected in either one of the temperature difference and a current value, the above-mentioned control can be performed. As a result, safety can be ensured in a further multiple manner.

<Modification 3>

In modification 2, a control is performed by grasping a phenomenon which becomes a trigger of the occurrence of a disproportionation reaction based on only shell temperature Tsh. However, the present invention is not limited to such a configuration.

A control for suppressing occurrence of a disproportionation reaction may also be performed by grasping a phenomenon which becomes a trigger of occurrence of a disproportionation reaction based on direct measurement of a temperature of stator 5022*e* by stator temperature detecting part 510*c*.

As shown in FIG. 14, stator temperature detecting part 510*c* is disposed near coil end portion 5023*e* of stator 5022*e* or in a freezing machine oil return passage (not shown) formed in a gap between stator 5022*e* and hermetically sealed vessel 502*g*. With such a configuration, a temperature of stator 5022*e* can be directly measured.

Hereinafter, modification 3 of a control for suppressing occurrence of a disproportionation reaction using a temperature of stator 5022*e* is described with reference to FIG. 18.

A flowchart for the control is substantially equal to flowchart 50*c* shown in FIG. 18 described in modification 2 except for the detection of a temperature of stator 5022*e*.

Firstly, a set temperature detected by stator temperature detecting part 510*c* for shutting down the supply of electricity to compressor 502 is described.

The above-mentioned set temperature is set to a temperature by taking into account the tolerance in safety in view of a temperature at which an insulator is broken. Accordingly, in the same manner as modification 2, assume a temperature at which the insulator is broken as 200° C., for example.

In case of modification 3, the control is performed by setting a set temperature of stator temperature detecting part 510*c* to 170° C., for example. The reason is that stator temperature detecting part 510*c* can directly detect a temperature of stator 5022*e* unlike shell temperature Tsh in modification 2 so that the smaller tolerance of 30° C. is estimated.

In the same manner as modification 2, stator temperature detecting part 510*c* may be formed of an electric element or a mechanical element. Further, stator temperature detecting part 510*c* may be formed of both of an electric element and a mechanical element. In this case, safety can be ensured in a multiple manner.

The control method of modification 3 is described with reference to FIG. 18 hereinafter.

As shown in FIG. 18, in the same manner as modification 2, a temperature of stator 5022*e* is detected by stator temperature detecting part 510*c* (step S300). At this stage of operation, after the detection by stator temperature detecting part 510*c*, a detection value of stator temperature detecting part 510*c* is recorded in the control circuit.

Next, the control circuit determines whether or not a temperature of stator 5022*e* has reached a predetermined value (170° C.) (step S310). When the temperature has not yet reached the predetermined value (No in step S310), an operation of compressor 502 is continued (step S380).

On the other hand, when the temperature has reached the predetermined value (Yes in step S310), the control circuit performs a control for shutting down the supply of electricity to compressor 502 (step S320).

In such a control, when a temperature of stator 5022*e* is electrically detected, a detection value from stator temperature detecting part 510*c* is transmitted to the control circuit as an electric signal through a signal line. Then, the control circuit outputs an instruction of shutting down the supply of electricity to a power source circuit which supplies electricity to compressor 502 when the temperature of stator 5022*e* reaches a predetermined value (for example, 170° C.). Accordingly, a switch for supplying electricity to compressor 502 is opened so that the supply of electricity is shut down. The above-mentioned signal line may be shared in common by electricity supply terminal 502*h* which supplies electricity to electric motor 502*e* or may be formed as a separate line from a line for supplying electricity from electricity supply terminal 502*h*. With such a configuration, a temperature of stator 5022*e* detected by stator temperature detecting part 510*c* can be transmitted to the outside of hermetically sealed vessel 502*g*.

On the other hand, in detecting a temperature of stator 5022*e* mechanically, a thermal relay may be disposed on a middle portion of lead line 502*i* which supplies electricity to electric motor 502*e* disposed in the inside of compressor 502, and the supply of electricity to compressor 502 may be shut down using the thermal relay.

In this case, it is desirable to adopt the configuration where the shutdown of the supply of electricity to compressor 502 is not automatically restored from a viewpoint of ensuring safety. That is, it is preferable to adopt the configuration where a restoring switch is disposed in a power source circuit, and the supply of electricity is not restored unless the restoring switch is turned on.

By performing the above-mentioned processing flow, the supply of electricity to compressor 502 can be shut down before a temperature of stator 5022*e* which becomes a trigger of a disproportionation reaction exceeds a predetermined value.

The flow of the control in step S330 and succeeding steps in modification 3 is substantially equal to the corresponding flow of the control in modification 2 and hence, the description of such a flow is omitted. That is, the control may be performed in the same manner while substituting "shell temperature" in modification 2 by "temperature of stator 5022*e*".

In the control performed in modification 3, a control for detecting a temperature of stator 5022*e* may be performed in combination with a control for detecting electricity supplied to compressor 502 and detection methods described in modification 1 and modification 2. With such a configuration, when abnormality is detected in any one of these detection methods, the above-mentioned control can be performed. As a result, safety can be ensured in a further multiple manner.

<Modification 4>

It is also possible to perform a control to suppress a disproportionation reaction by grasping a phenomenon which becomes a trigger of the occurrence of the disproportionation reaction using a pressure detected by discharge pressure detecting part 515*c* disposed on a discharge part of compressor 502.

That is, a discharge pressure is detected by discharge pressure detecting part 515*c* disposed on discharge pipe 502*b* of compressor 502 or in discharge space 502*d* of compressor 502 shown in FIG. 14, and the control is performed using the detected discharge pressure.

Hereinafter, modification 4 of a control for suppressing occurrence of a disproportionation reaction according to this exemplary embodiment is described with reference to FIG. 19.

Figure 19:
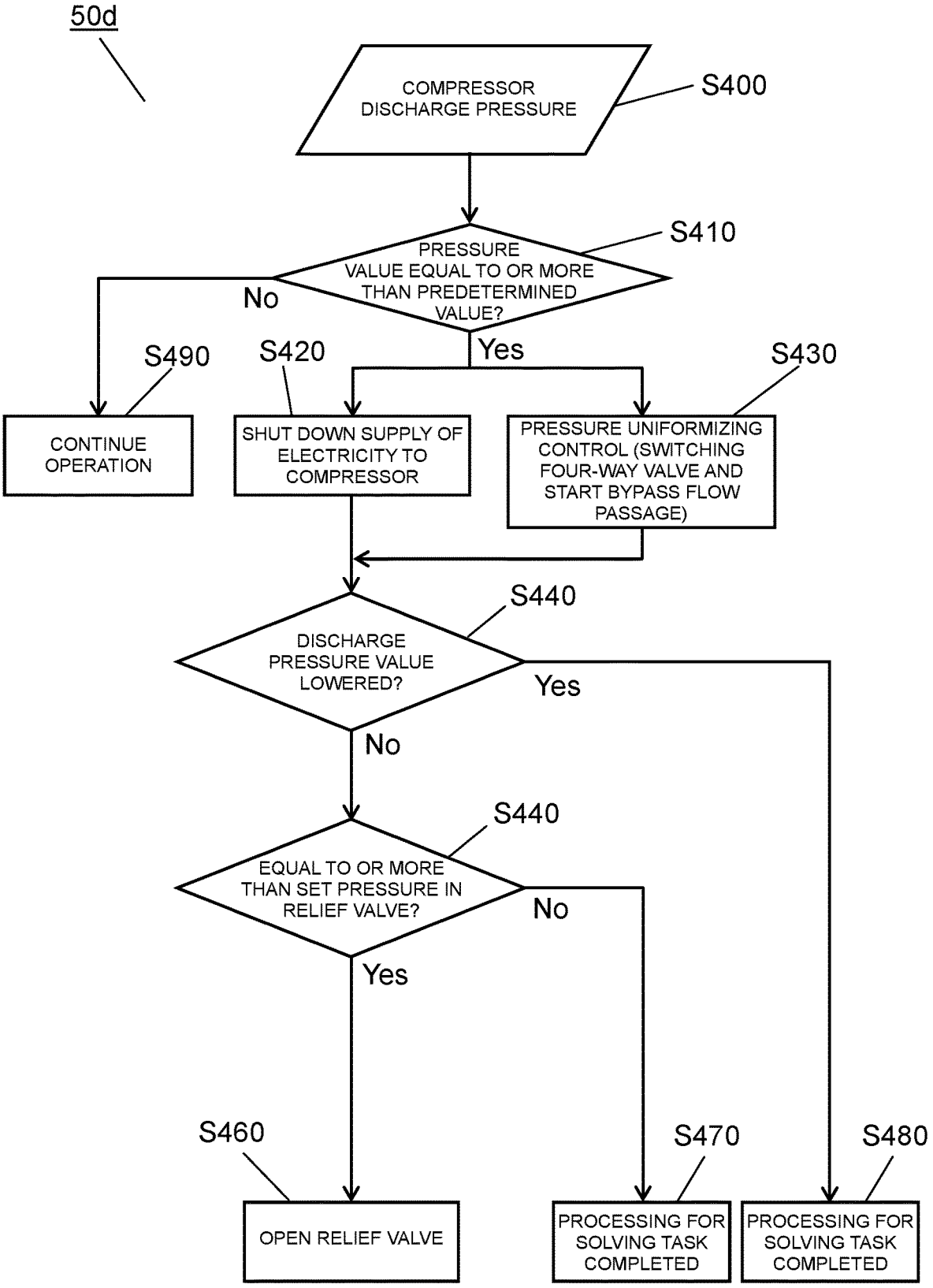
FIG. 19 is a flowchart for describing a control of modification 4 of the refrigeration cycle device according to the fifth exemplary embodiment of the present invention.

FIG. 19 is a flowchart for describing a control of modification 4 of the refrigeration cycle device according to the fifth exemplary embodiment of the present invention.

FIG. 19 shows flowchart 50*d* of a control for suppressing occurrence of a disproportionation reaction using a discharge pressure.

In the above-mentioned exemplary embodiment, it is described that when compression mechanism 502*c* is locked in compressor 502 of high pressure shell type so that a refrigerant does not flow (stagnates), a temperature of electric motor 502*e* and a temperature of a refrigerant around electric motor 502*e* are increased. In this case, when heat is applied to a refrigerant in discharge space 502*d* in compressor 502, a pressure of the refrigerant is also increased.

In view of the above, in modification 4, when a pressure of a discharge refrigerant is increased to a predetermined value (predetermined pressure) and a time during which the pressure of the discharge refrigerant exceeds the predetermined pressure continues for a predetermined time, the supply of electricity to compressor 502 is shut down. Accordingly, the configuration is provided where a control is performed so as to suppress a disproportionation reaction of a working fluid. That is, when a measured value of discharge pressure detecting part 515*c* reaches a predetermined value, the supply of electricity to compressor 502 is shut down.

In this case, the predetermined value of the discharge pressure at which the supply of electricity to compressor 502 is shut down may be, as described in modification 1 of the first exemplary embodiment, set such that the predetermined value does not reach a critical point pressure Pcri. An allowable pressure of compressor 502 may be set as the predetermined value. Further, the predetermined value may be set to an upper limit value on a high pressure side within a predetermined operation range (including a pump down operation time) of compressor 502.

With respect to a predetermined time, when an allowable pressure of compressor 502 is set as a predetermined pressure, the supply of electricity to compressor 502 should be shut down immediately after the allowable pressure is recorded in the control circuit and hence, it is desirable that the predetermined time is not provided. On the other hand, when an upper limit value on a high pressure side in a predetermined operation of compressor 502 is set as a predetermined pressure, it is desirable that a control is performed so as to shut down the supply of electricity to compressor 502 when a time during which a pressure of a refrigerant exceeds the predetermined pressure is continuously measured for a fixed time (for example, in the order of minutes).

Discharge pressure detecting part 515*c* may be configured to measure a discharge pressure by electrically detecting a strain of a diaphragm to be pressurized by a strain gauge or the like. Discharge pressure detecting part 515*c* may be also formed of a metal bellows or a metal diaphragm which mechanically detects a pressure.

Hereinafter, a control according to modification 4 is specifically described with reference to FIG. 19.

As shown in FIG. 19, firstly, a discharge pressure of compressor 502 is detected by discharge pressure detecting part 515*c* (step S400). At this stage of operation, a detection value of the discharge pressure of compressor 502 is recorded in the control circuit.

Next, the control circuit determines whether or not the detection value of the discharge pressure of compressor 502 is equal to or more than a predetermined value and whether or not such a detection is continued for the above-mentioned predetermined time (step S410). When the discharge pressure is less than the predetermined value (No in step S410), an operation of compressor 502 is continued (step S490).

On the other hand, when the detection value of the discharge pressure of compressor 502 is equal to or more than the predetermined value and the detection value is continuously detected for the predetermined time (Yes in step S410), a control is performed so as to shut down the supply of electricity to compressor 502 (step S420). At this stage of operation, the detection value of the discharge pressure is recorded in the control circuit.

More specifically, a control to shut down the supply of electricity to compressor 502 is performed as follows.

For example, in case of electrically detecting a pressure, when the pressure reaches a predetermined value, an instruction to shut down the supply of electricity to compressor 502 is transmitted to the power source circuit from the control circuit. On the other hand, in case of mechanically detecting a pressure, when the pressure reaches a predetermined value, for example, a spring or the like is pushed and a contact for a supply power source to compressor 502 is opened. Accordingly, the supply of electricity to compressor 502 is shut down. Step S420 is substantially equal to step S120 in flowchart 50*a* of the exemplary embodiment and hence, the detailed description of step S420 is omitted.

By performing the above-mentioned processing flow, the supply of electricity to compressor 502 can be shut down before a discharge pressure of compressor 502 which becomes a trigger for a disproportionation reaction exceeds a predetermined value.

In the same manner as step S130 in flowchart 50*a* of the above-mentioned exemplary embodiment, also in modification 4, as shown in step S430, a control of four-way valve 506, bypass open/close valve 513*a* of bypass flow passage 513 and relief valve 514 may be performed using a detection value of the discharge pressure. In this case, set values used in the control of four-way valve 506 and bypass open/close valve 513*a* may be set in the same manner as the set values used for shutting down the supply of electricity described in the above-mentioned exemplary embodiment. Step S430 is substantially equal to step S130 in the exemplary embodiment and hence, the detailed description of step S430 is omitted.

In step S430 in modification 4, even when a pressure of a refrigerant is changed to a uniform pressure state, it is difficult to suppress the occurrence of a disproportionation reaction with certainty. Further, there may be also a case where the supply of electricity to compressor 502 is not shut down.

In view of the above, in modification 4, as shown in FIG. 19, it is determined whether or not a discharge pressure value is lowered (step S440). When the discharge pressure value is lowered (Yes in step S440), processing taken to cope with the case where discharge pressure value is not lowered is completed (step S470).

On the other hand, when discharge pressure value is not lowered (No in step S440), it is determined whether or not an increased pressure is equal to or above a set pressure of relief valve 514 (step S450). When the increased pressure is equal to or above the set pressure of relief valve 514 (Yes in step S450), relief valve 514 is opened (step S460).

On the other hand, when the increased pressure is less than the set pressure of relief valve 514 (No in step S450), processing taken to cope with the case where the increased pressure is not equal to or above the set pressure of relief valve 514 is completed (step S470).

Then, the above-mentioned processing is performed for a predetermined time or is performed constantly and repeatedly so as to control the refrigeration cycle device.

With the above-mentioned operations, the occurrence of a disproportionation reaction can be suppressed by using a discharge pressure detected by discharge pressure detecting part 515*c*.

In modification 4, in electrically detecting a pressure, in addition to the shutdown of the supply of electricity to compressor 502, an open control of the above-mentioned respective valves may be performed by the control circuit. In this case, the configuration can be simplified.

In modification 4, in mechanically detecting a pressure, for example, a spring-type valve may be used. More specifically, in case of bypass open/close valve 513*a* disposed in bypass flow passage 513, a pressure at a primary (high) pressure side is set as a discharge pressure, and a pressure at a secondary (low) pressure side is set as a suction pressure.

In modification 4, in case of relief valve 514, a pressure at a primary pressure side may be set as a refrigerant pressure in a refrigeration cycle and a pressure at a secondary pressure side is set as a pressure of surrounding air.

In the control performed in modification 4, the control may be performed using both of an electrical pressure detecting part and a mechanical pressure detecting part. With such a configuration, safety can be ensured in a multiple manner.

In the control performed in modification 4, the detection of the supply of electricity to compressor 502 and the detections performed in modification 1 to modification 3 may be performed in combination. With such a control, when either one of detections detects abnormality, the above-mentioned controls can be performed. As a result, safety can be ensured in a multiple manner and hence, such a configuration is more preferable.

As has been described heretofore, the refrigeration cycle device according to the present invention includes a refrigeration cycle which is formed by connecting a compressor, a condenser, an expansion valve and an evaporator to each other. A working fluid containing 1,1,2-trifluoroethylene (R1123) and difluoromethane (R32) is used as a refrigerant sealed in the refrigeration cycle. A degree of opening of the expansion valve may be controlled such that the refrigerant has two phases at a suction portion of the compressor.

With such a configuration, it is possible to prevent a working fluid from entering a body of the compressor in a superheated state. Accordingly, it is possible to prevent the occurrence of a phenomenon that a compressor discharge temperature of the working fluid is excessively increased so that the molecular movement of R1123 in the working fluid is activated. As a result, a disproportionation reaction of a working fluid containing R1123 is suppressed so that a highly reliable refrigeration cycle device can be provided.

The refrigeration cycle device according to the present invention includes a condensation temperature detecting part disposed in the condenser, wherein the degree of opening of the expansion valve may be controlled such that a difference between a critical temperature of the working fluid and a condensation temperature detected by the condensation temperature detecting part becomes 5K or more.

With such a configuration, a pressure which corresponds to a working fluid temperature measured by the condensation temperature detecting part is obtained, and a degree of opening of the expansion valve is controlled such that a high-pressure-side working fluid temperature (pressure) is restricted to 5K or more from a critical pressure by taking into tolerance in safety. Accordingly, it is possible to prevent a higher condensation pressure from being excessively increased so that a disproportionation reaction which is likely to occur due to the excessive pressure increase (activation of molecular movement) can be suppressed. As a result, reliability of the refrigeration cycle device can be ensured.

The refrigeration cycle device according to the present invention includes a high-pressure-side pressure detecting part disposed between a discharge portion of the compressor and an inlet of the expansion valve, and the degree of opening of the expansion valve is controlled such that a difference between a critical pressure of the working fluid and a pressure detected by the high-pressure-side pressure detecting part becomes 0.4 MPa or more.

With such a configuration, when a working fluid containing R1123 is used at a mixing ratio which brings about a nonazeotropic state where a temperature gradient is particularly large, a refrigerant pressure can be detected more accurately. Further, a degree of opening of the expansion valve is controlled based on a detection result. Accordingly, a high-pressure-side pressure (condensation pressure) in the refrigeration cycle device can be lowered. As a result, reliability of the refrigeration cycle device can be enhanced by suppressing occurrence of a disproportionation reaction of a working fluid.

The refrigeration cycle device according to the present invention further includes: a bypass pipe which connects a portion disposed between the condenser and the expansion valve and a portion disposed between the expansion valve and the evaporator to each other; and a bypass open/close valve for opening or closing the bypass flow passage, wherein the bypass open/close valve may be opened when the refrigerant does not have two phases at the suction portion of the compressor in a state where a degree of opening of the expansion valve becomes full-open.

With such a configuration, compared to the case where only the expansion valve is operated singly, it is possible to perform a pressure control of a working fluid containing R1123 more rapidly. As a result, reliability of the refrigeration cycle device can be further enhanced.

In the refrigeration cycle device according to the present invention, the compressor may be stopped when the refrigerant does not have two phases at the suction portion of the compressor in a state where a degree of opening of the expansion valve becomes full-open.

With such a configuration, it is possible to suppress the factors which affect the increase of a pressure of a working fluid containing R1123 due to a stop of compressor to only a disproportionation reaction and a heat exchange with a surrounding medium. Accordingly, reliability of the refrigeration cycle device can be further enhanced.

The refrigeration cycle device according to the present invention further includes a relief valve which communicates with a space outside the refrigeration cycle, wherein the relief valve may be opened when the refrigerant does not have two phases at the suction portion of the compressor in a state where a degree of opening of the expansion valve becomes full-open.

With such a configuration, even when a disproportionation reaction occurs and progresses, a pressure can be released by discharging the refrigerant to the outside. Accordingly, breaking of the refrigeration cycle device can be prevented. As a result, the reliability of the refrigeration cycle device can be further enhanced.

In the refrigeration cycle device according to the present invention, the compressor may include an electric motor, and supply of electricity to the compressor may be stopped for suppressing occurrence of a disproportionation reaction of the refrigerant when abnormal heat generation having a higher temperature than a predetermined value occurs in the electric motor.

With such a configuration, it is possible to prevent the excessive supply of electricity to the compressor which becomes a trigger for a disproportionation reaction. Accordingly, the occurrence or a progress of a disproportionation reaction can be suppressed in advance.

In the refrigeration cycle device according to the present invention, determination may be made that the abnormal heat generation occurs when a time at which a supply current to the electric motor reaches a current value at a time of a breakdown torque of the electric motor exceeds a predetermined time.

In the refrigeration cycle device according to the present invention, a determination may be made that the abnormal heat generation occurs when stopping of rotational movement of a rotor of the electric motor is detected.

With these configurations, the excessive supply of electricity to the compressor which becomes a trigger for a disproportionation reaction can be detected. As a result, the occurrence or the progress of a disproportionation reaction caused by abnormal heat generation can be suppressed.

In the refrigeration cycle device according to the present invention, the compressor may include a hermetically sealed vessel for housing the electric motor, and include: a shell temperature detecting part disposed near a position where a stator of the electric motor is disposed in the hermetically sealed vessel; and a discharge temperature detecting part disposed on a discharge portion of the compressor, and a determination may be made that the abnormal heat generation occurs when a time at which a difference between a detection value of the discharge temperature detecting part and a detection value of the shell temperature detecting part exceeds a predetermined value exceeds a predetermined time.

With such a configuration, the excessive supply of electricity to the compressor can be shut down before a disproportionation reaction occurs. As a result, the occurrence or the progress of a disproportionation reaction caused by abnormal heat generation can be suppressed in advance.

The refrigeration cycle device according to the present invention may further include a stator temperature detecting part for detecting a temperature of a stator of the electric motor, wherein the determination may be made that the abnormal heat generation occurs when a time at which a detection value of the stator temperature detecting part reaches a predetermined value exceeds a predetermined time.

With such a configuration, it is possible to prevent the occurrence of a phenomenon that a refrigerant becomes a high temperature atmosphere which is one of conditions that a disproportionation reaction occurs or progresses. As a result, the occurrence or the progress of a disproportionation reaction caused by abnormal heat generation can be suppressed in advance.

The refrigeration cycle device according to the present invention may further include a discharge portion pressure detecting part disposed on a discharge portion of the compressor, wherein a determination may be made that the abnormal heat generation occurs when a time at which a detection value of the discharge portion pressure detecting part reaches a predetermined value exceeds a predetermined time.

The refrigeration cycle device according to the present invention may further include a four-way valve which switches a flow of a refrigerant discharged from the compressor, wherein when a determination is made that the abnormal heat generation occurs, communication of the four-way valve may be switched to a direction opposite to a direction before the occurrence of the abnormal heat generation.

The refrigeration cycle device according to the present invention may further include: a bypass flow passage which makes a portion between the four-way valve and a suction portion of the compressor and a portion between the four-way valve and a discharge portion of the compressor to each other; and a bypass open/close valve disposed in the bypass flow passage, wherein when the determination is made that the abnormal heat generation occurs, the bypass open/close valve may be opened.

The refrigeration cycle device according to the present invention may further include an atmosphere open portion which is disposed between the four-way valve and a discharge portion of the compressor and releases a refrigerant to a surrounding atmosphere, wherein when the determination is made that the abnormal heat generation occurs, the atmosphere open portion may be opened.

With such configurations, it is possible to prevent the occurrence of a phenomenon that a refrigerant becomes a high pressure atmosphere which is one of conditions that a disproportionation reaction occurs or progresses. As a result, the occurrence or the progress of a disproportionation reaction caused by abnormal heat generation can be suppressed in advance.

INDUSTRIAL APPLICABILITY

The present invention is applicable to a refrigeration cycle device used in applications which uses a working fluid containing R1123 such as a water heater, a car air conditioner, a freezer refrigerator, and dehumidifier, for example.

REFERENCE MARKS IN THE DRAWINGS

1, 20, 30, 40, 50: refrigeration cycle device
2, 502: compressor
2*a*, 3*a*, 4*a*: inlet
2*b*, 3*b*, 4*b*, 5*b*: outlet
3: condenser
4, 504: expansion valve
5: evaporator
6: refrigerant pipe
7*a*, 7*b*: fluid machine
8: isothermal line
9: saturation liquid line (saturation vapor line)
10*a*: condensation temperature detecting part
10*b*: condenser outlet temperature detecting part
10*c*: vapor temperature detecting part
10*d*: suction temperature detecting part
10*e*: first medium temperature detecting part
10*f*: second medium temperature detecting part
11: flare-type union

12: seal
13, 513: bypass flow passage
13*a*, 513*a*: bypass open/close valve
14, 514: relief valve (atmosphere open portion)
15*a*: high-pressure-side pressure detecting part
15*b*: low-pressure-side pressure detecting part
16: flow passage of surrounding medium
17: pipe joint
50*a*, 50*b*, 50*c*, 50*d*: flowchart
501*a*: indoor unit
501*b*: outdoor unit
502*a*: suction pipe
502*b*: discharge pipe
502*c*: compression mechanism
502*d*: discharge space
502*e*: electric motor
502*h*: electricity supply terminal
502*i*: lead line
502*g*: hermetically sealed vessel
502*i*: discharge muffler
502*m*: crankshaft
5021*e*: rotor
5022*e*: stator
5023*e*: coil end portion
503: indoor heat exchanger
505: outdoor heat exchanger
506: four-way valve
507*a*: indoor blower fan
507*b*: outdoor blower fan
508: three-way valve
508*a*: valve
508*b*: service valve
509: two-way valve
510*a*: shell temperature detecting part
510*b*: discharge pipe temperature detecting part
510*c*: stator temperature detecting part
511*a*: liquid pipe
511*b*: gas pipe
512*a*, 512*b*, 512*c*, 512*d*: pipe joint portion
515*c*: discharge pressure detecting part
520: temperature history

The invention claimed is:

1. A refrigeration cycle device comprising a refrigeration cycle which is formed by connecting a compressor, a condenser, an expansion valve and an evaporator to each other,
wherein
a working fluid containing 1,1,2-trifluoroethylene (R1123) and difluoromethane (R32) is used as a refrigerant sealed in the refrigeration cycle, and
a degree of opening of the expansion valve is controlled such that the refrigerant has two phases at a suction portion of the compressor,
the refrigeration cycle device further comprising: a bypass flow passage which connects a portion disposed between the condenser and the expansion valve and a portion disposed between the expansion valve and the evaporator to each other; and a bypass open/close valve for opening or closing the bypass flow passage,
wherein the bypass open/close valve is configured to be opened when the refrigerant does not have two phases at the suction portion of the compressor in a state where the degree of opening of the expansion valve becomes full-open.

2. A refrigeration cycle device comprising a refrigeration cycle which is formed by connecting a compressor, a condenser, an expansion valve and an evaporator to each other,
wherein
a working fluid containing 1,1,2-trifluoroethylene (R1123) and difluoromethane (R32) is used as a refrigerant sealed in the refrigeration cycle,
a degree of opening of the expansion valve is controlled such that the refrigerant has two phases at a suction portion of the compressor, and
the compressor is configured to be stopped when the refrigerant does not have two phases at the suction portion of the compressor in a state where the degree of opening of the expansion valve becomes full-open.

3. A refrigeration cycle device comprising a refrigeration cycle which is formed by connecting a compressor, a condenser, an expansion valve and an evaporator to each other,
wherein
a working fluid containing 1,1,2-trifluoroethylene (R1123) and difluoromethane (R32) is used as a refrigerant sealed in the refrigeration cycle, and
a degree of opening of the expansion valve is controlled such that the refrigerant has two phases at a suction portion of the compressor,
the refrigeration cycle device further comprising a relief valve which communicates with a space outside the refrigeration cycle,
wherein the relief valve is configured to be opened when the refrigerant does not have two phases at the suction portion of the compressor in a state where the degree of opening of the expansion valve becomes full-open.

4. A refrigeration cycle device comprising a refrigeration cycle which is formed by connecting a compressor, a condenser, an expansion valve and an evaporator to each other,
wherein
a working fluid containing 1,1,2-trifluoroethylene (R1123) and difluoromethane (R32) is used as a refrigerant sealed in the refrigeration cycle,
a degree of opening of the expansion valve is controlled such that the refrigerant has two phases at a suction portion of the compressor, and
the compressor includes an electric motor, and supply of electricity to the compressor is stopped for suppressing a disproportionation reaction of the refrigerant when abnormal heat generation having a higher temperature than a predetermined value occurs in the electric motor,
the refrigeration cycle device further comprising a four-way valve which switches a flow of a refrigerant discharged from the compressor,
wherein when a determination is made that the abnormal heat generation occurs, communication of the four-way valve is switched to a direction opposite to a direction before the occurrence of the abnormal heat generation.

5. The refrigeration cycle device according to claim 4, further comprising: a bypass flow passage which makes a portion between the four-way valve and a suction portion of the compressor and a portion between the four-way valve and a discharge portion of the compressor communicate with each other; and a bypass open/close valve disposed in the bypass flow passage,
wherein
when the determination is made that the abnormal heat generation occurs, the bypass open/close valve is opened.

6. The refrigeration cycle device according to claim 4, further comprising an atmosphere open portion which is disposed between the four-way valve and a discharge portion of the compressor and releases a refrigerant to a surrounding atmosphere, wherein when the determination is made that the abnormal heat generation occurs, the atmosphere open portion is opened.

* * * * *